US012741841B2

(12) United States Patent
Peutl et al.

(10) Patent No.: US 12,741,841 B2
(45) Date of Patent: Sep. 22, 2026

(54) TRANSPORT APPARATUS FOR SUPPLY ROLLS WITH PACKAGING MATERIAL WOUND THEREON

(71) Applicant: Krones Aktiengesellschaft, Neutraubling (DE)

(72) Inventors: August Peutl, Woerth an der Donau (DE); Martin Wagner, Regensburg (DE); Oliver Kotz, Prien am Chiemsee (DE); Andreas Hack, Dingolfing (DE)

(73) Assignee: Krones Aktiengellschaft, Neutraubling (DE)

( * ) Notice: Subject to any disclaimer, the term of this patent is extended or adjusted under 35 U.S.C. 154(b) by 353 days.

(21) Appl. No.: 18/266,736

(22) PCT Filed: Dec. 8, 2021

(86) PCT No.: PCT/EP2021/084738
§ 371 (c)(1),
(2) Date: Jun. 12, 2023

(87) PCT Pub. No.: WO2022/144152
PCT Pub. Date: Jul. 7, 2022

(65) Prior Publication Data

US 2024/0051779 A1 Feb. 15, 2024

(30) Foreign Application Priority Data

Jan. 4, 2021 (DE) ..... 10 2021 100 035.1

(51) Int. Cl.
*B65H 19/12* (2006.01)

(52) U.S. Cl.
CPC ... *B65H 19/123* (2013.01); *B65H 2301/4173* (2013.01); *B65H 2301/4175* (2013.01);
(Continued)

(58) Field of Classification Search
CPC ..... B65B 41/12; B25J 5/007; B65H 19/123; B65H 19/30; B65H 2301/4175;
(Continued)

(56) References Cited

U.S. PATENT DOCUMENTS 5,219,127 A 6/1993 Boldrini et al.
5,274,984 A * 1/1994 Fukuda ..... B65B 41/16 414/908

(Continued)

FOREIGN PATENT DOCUMENTS

CN 107683249 A 2/2018
CN 111717706 * 9/2020 ..... B65H 19/30

(Continued)

OTHER PUBLICATIONS

CN Application First Office Action dated May 28, 2025.

(Continued)

*Primary Examiner* — Linda J. Hodge
(74) *Attorney, Agent, or Firm* — Simmons Perrine PLC

(57) ABSTRACT

The invention includes a transport apparatus (1) for supply rolls (8) with packaging material wound thereon. The transport apparatus (1) comprises at least one driverless transport vehicle (2) and at least one adapter (3). The adapter (3) is preferably connectable to the driverless transport vehicle (2), as well as being separable from the driverless transport vehicle (2). The adapter (3) is moreover designed to hold at least one supply roll (8).

21 Claims, 32 Drawing Sheets

(52) U.S. Cl.
CPC .. *B65H 2405/4221* (2013.01); *B65H 2555/30* (2013.01); *B65H 2801/81* (2013.01)

(58) Field of Classification Search
CPC ..... B65H 2301/4173; B65H 2301/418; B65H 2405/4221; B65H 2555/30; B65H 2801/81; B65H 2405/4223; B65H 67/04; B65H 67/06
USPC ..... 53/389.1, 389.4, 168; 242/558, 559; 414/222.13, 911
See application file for complete search history.

(56) References Cited

U.S. PATENT DOCUMENTS

| | | | | |
|---|---|---|---|---|
| 5,593,107 | A | 1/1997 | Focke et al. | |
| 8,444,369 | B2 * | 5/2013 | Watt | B65G 37/02 414/809 |
| 10,793,384 | B2 | 10/2020 | Nagafuchi et al. | |
| 11,591,122 | B2 | 2/2023 | Wipf | |
| 2002/0162299 | A1 * | 11/2002 | Focke | B65H 37/04 53/168 |
| 2017/0233206 | A1 * | 8/2017 | Wimmer | B65H 19/123 242/554 |
| 2020/0156813 | A1 * | 5/2020 | Wipf | B25J 15/0047 |
| 2022/0009185 | A1 * | 1/2022 | Dettorre | B65H 19/12 |

FOREIGN PATENT DOCUMENTS

| | | | | |
|---|---|---|---|---|
| DE | 1906554 | A1 | 8/1970 | |
| DE | 102004026312 | A1 | 12/2005 | |
| DE | 102006053983 | * | 5/2008 | B65H 19/123 |
| JP | 2016003134 | A | 1/2016 | |
| WO | WO-2018054588 | A1 * | 3/2018 | B65H 26/00 |
| WO | WO-2021052914 | A1 * | 3/2021 | B65G 69/006 |

OTHER PUBLICATIONS

PCT Application: PCT/EP2021/084738 Filed Dec. 8, 2021—International Preliminary Report on Patentability dated Jul. 13, 2023.
PCT/EP2021/084738 filed Dec. 8, 2021—International Search Report dated May 10, 2022.
CN Application Second Office Action dated Jan. 22, 2026.
Chinese Office Action dated Apr. 28, 2026.
NPL: Theory of Multi-Sensor Information Fusion and Estimation, and its Applications in Intelligent Manufacturing—Copyright 2018.

* cited by examiner

TRANSPORT APPARATUS FOR SUPPLY ROLLS WITH PACKAGING MATERIAL WOUND THEREON

CLAIM OF PRIORITY

The present application claims priority to International Application PCT/EP2021/084738 dated Dec. 8, 2021, which in turn claims priority to German Application DE 10 2021 100 035.1 dated Jan. 4, 2021, which are incorporated by reference.

FIELD OF THE INVENTION

The present invention relates to a transport apparatus for supply rolls with packaging material wound thereon, to a packaging system, and to a method to operate a packaging apparatus.

BACKGROUND OF THE INVENTION

It is common in practice to have a grouped set of articles, such as beverage containers or the like, held together by shrink film in order to be able to prevent the set from shifting or from coming undone during a transport. Packs comprising four, six, or more containers, for example, are known from the prior art. Such packs continue to be one of the most frequent variants of sales units for beverage containers or bottles of PET plastic. It is therefore desirable to assemble such packs as quickly as possible without interruption of individual process steps in order to be able to achieve a high throughput.

Apparatuses and methods are already known that unwind the packaging material or the shrink film from one or more rolls in order to supply the material to the packs. The individual packs or the particular articles provided for the pack, are subsequently wrapped into the packaging material. The unwinding of the packaging material from the roll can be carried out by machine. Apparatuses are known that extract the packaging material from the roll by rollers, for example, with the particular roll meanwhile being rotatingly moved. After the supply of packaging material on a roll is depleted, the roll in question has to be exchanged by or replaced with a new roll.

A method that can be used to feed supply rolls to a packaging apparatus is known from DE 40 40 545 A1, for example. The apparatus as known from the DE patent application has a plurality of reels for supplying strip material arranged side by side in the packaging machine. The core of the reels is in each instance positioned on a common pin. A beginning section of the strip material is previously brought into contact with a roller, which extracts the strip material from the particular reel and guides it in a downward direction away from the apparatus. In apparatuses according to the DE patent application, a user transports the reels to the packaging machine and then positions them on a pin. It would be desirable to have possibilities to operate such a packaging apparatus with a reduced input of personnel.

An apparatus is known from DE 10 2004 026 312 A1 with a foil splicing station where the foil web of a new roll that is mounted into a packaging machine is transferred with the support of a holding device to a sealing device. The holding device can be formed, in particular, as a manually operable clamping strip, with the aid of which a foil beginning can be extracted from a new roll and provided to a transfer device, which can feed the foil beginning to a sealing device, by which the foil beginning is heat-sealed to a foil web that is already located in the packaging machine. The clamping strip is described there as an implement that is easy to handle for bringing the foil web into an appropriate position. The clamping strip is loose, however, that is, it is not linked to the machine or to the sealing device.

DE 42 21 052 A1 discloses an apparatus for handling reels with webs of material wound thereon, the material webs being primarily intended to be used as packaging material in packaging machines. For this purpose, the reels are picked up, transported, and deposited at the packaging machine by reel conveyors, which are movable above a processing machine with the aid of a reel holder seizing one reel at a time. The reel holder is to be variably adjustable relative to the reel conveyor such that it serves to bring reels to any position and to deposit them there. Such reel conveyors require much space and may be prone to errors. It would be desirable to have possibilities to replace supply rolls with a low personnel input.

It is therefore to be seen as an object of the invention to provide a possibility that allows feeding supply rolls to a packaging apparatus in a manner that is simple compared to the prior art. Moreover, this possibility of feeding supply rolls to a packaging machine should have a low susceptibility to failure.

The above tasks are fulfilled by the objects comprising the features in the independent claims. Advantageous embodiments of the invention are described in the dependent claims.

SUMMARY OF THE INVENTION

The invention relates to a transport apparatus for supply rolls with packaging material wound thereon. The packaging material can be shrink film or a thermoplastic packaging material, for example. The supply rolls can have a hollow cylindrical core on which the packaging material is wound.

The transport apparatus comprises at least one automatically controlled driverless transport vehicle or at least one automatically controlled AGV or at least one automatically controlled floor-bound conveying device with its own travel drive. The transport apparatus further comprises at least one adapter, which is preferably designed to be separably connected to the at least one driverless transport vehicle and to hold at least one supply roll.

Embodiments have proved successful in which the at least one adapter is designed such that the at least one driverless transport vehicle can drive under the at least one adapter. It is possible in other embodiments for the at least one driverless transport vehicle to remain in its particular position and for the at least one adapter to be slid onto the at least one driverless transport vehicle.

It is further possible that the at least one adapter comprises at least one holding mandrel on which it is possible to position a particular supply roll. It is possible in other embodiments for the at least one adapter to comprise at least one holding device, which can be brought into contact with the outer side of the particular supply roll by force application in order to hold the particular supply roll to the at least one adapter. It is also conceivable for the at least one adapter to comprise or form a tray on which the supply roll can be deposited such that the at least one adapter holds the supply roll.

It is possible that the at least one adapter has a frame structure that supports a holding mandrel. The frame structure can have support feet arranged to it, via which support feet the at least one adapter can stand on a floor surface. It is also possible that the frame structure comprises no support feet, and that the frame structure is positioned on the at least one driverless transport vehicle in an embodiment of the method that will be described below.

Embodiments have proved successful in which the at least one holding mandrel is designed to be adjustable back and forth between at least one working position and at least one driving position. It is possible in this context that, in the at least one working position, the at least one holding mandrel of the at least one adapter connected to the particular driverless transport vehicle extends beyond a lateral circumference of the particular at least one driverless transport vehicle or AGV or is situated outside a lateral circumference of the particular driverless transport vehicle or AGV.

It is further possible that, in the at least one driving position, the at least one holding mandrel of the at least one adapter connected to the particular driverless transport vehicle, is situated, at least in sections or completely, behind the lateral circumference of the particular at least one driverless transport vehicle. In this way it is possible to minimize the risk of an inadvertent collision with the supply roll during a movement of the driverless transport vehicle. This also reduces the risk of the driverless transport vehicle being inadvertently overturned in a movement, potentially together with the supply roll already being held, due to the usually high mass of such a supply roll.

It is conceivable for the at least one adapter to have at least one support arm, on which at least one support arm the at least one holding mandrel is arranged. In order to transfer the particular at least one holding mandrel arranged on the at least one support arm from the at least one working position into the at least one driving position and from the at least one driving position into the at least one working position, the at least one support arm can moreover be designed to be in each instance swivelable about a horizontally oriented axis.

Alternatively or additionally, it is possible that the at least one adapter has at least one support arm, on which at least one support arm the at least one holding mandrel is arranged, with the transport apparatus moreover having at least one linear actuator, to which the at least one support arm is connected.

In order to transfer the particular at least one holding mandrel arranged on the at least one support arm from the at least one working position into the at least one driving position and from the at least one driving position into the at least one working position, it is possible that the at least one support arm is in each instance adjustable in linear direction via the at least one linear actuator.

It is also possible that the transport apparatus has at least one linear actuator or at least one further linear actuator, via which actuator the at least one holding mandrel can be moved up and down in vertical direction.

Embodiments have proved successful in which the at least one adapter has at least one tilt mechanism, via which at least one tilt mechanism a tilt adjustment about a horizontally oriented axis of the at least one holding mandrel relative to the at least one support arm is achievable actuatorically and preferably electrically or with the help of an electric actuator.

Accordingly, it is possible for the transport apparatus to have at least one electric motor, via which at least one electric motor a tilt adjustment about a horizontally oriented axis of the at least one holding mandrel relative to the at least one support arm is achievable. In alternative embodiments, it can be provided that the at least one adapter has at least one tilt mechanism, via which at least one tilt mechanism a tilt adjustment about a horizontally oriented axis of the at least one holding mandrel relative to the at least one support arm is achievable actuatorically and pneumatically or hydraulically.

In this context, it is possible for the transport apparatus to have at least one pneumatic cylinder, via which at least one pneumatic cylinder a tilt adjustment about a horizontally oriented axis of the at least one holding mandrel relative to the at least one support arm is achievable.

As already mentioned above, it is possible in other embodiments for the at least one adapter to comprise at least one holding device, which can be brought into contact with the outer side of the particular supply roll by force application in order to hold the particular supply roll to the at least one adapter. In such embodiments it is possible that the at least one adapter has at least one tilt mechanism, via which at least one tilt mechanism a tilt adjustment about a horizontally oriented axis of the at least one holding device relative to the at least one support arm is achievable actuatorically and preferably electrically or pneumatically or hydraulically.

It is furthermore possible for the transport apparatus to comprise at least one tilt sensor, an actuator, and a control device and/or regulating device in contact with the at least one tilt sensor and with the actuator. The actuator can furthermore be formed by at least one pneumatic cylinder or by at least one electric motor. The control device and/or regulating device can be designed to detect an actual tilt of the particular at least one holding mandrel relative to the support arm with the help of the at least one tilt sensor.

The control device and/or regulating device can furthermore be designed to automatically control the actuator to adjust the tilt position of the at least one holding mandrel if the actual tilt of the at least one holding mandrel relative to the support arm detected via the control device and/or regulating device with the help of the at least one tilt sensor deviates from a specified target tilt.

Embodiments have proved successful in which the at least one driverless transport vehicle can independently receive the at least one adapter and independently connect to the at least one received adapter in a separable manner.

Alternatively or additionally, it can be provided in various embodiments that the at least one driverless transport vehicle can independently separate an existing connection to the at least one already received adapter and independently deposit the at least one already received adapter.

Furthermore, the at least one driverless transport vehicle and/or the at least one adapter can have a lifting mechanism, via which lifting mechanism the at least one adapter is liftable relative to the at least one transport vehicle for the purpose of the independent receiving, such that the at least one adapter loses an up to then existing surface contact with a floor surface.

It is alternatively or additionally possible for the at least one driverless transport vehicle and the at least one adapter to interact via a centering mechanism, which centering mechanism can align the at least one adapter relative to the at least one transport vehicle when the adapter is independently received via the at least one transport vehicle.

It can alternatively or additionally be provided that the at least one driverless transport vehicle and the at least one adapter interact via a clamp bolt and a clamping mechanism, via which clamp bolt and clamping mechanism the at least one adapter can be at least largely immovably fixed to the driverless transport vehicle. The clamp bolt can be designed as part of the at least one adapter. The clamping mechanism can be designed as part of the at least one driverless transport vehicle.

It is possible for the at least one driverless transport vehicle to be in contact with at least one sensor system, via which at least one sensor system the at least one driverless transport vehicle can detect an actual position of the at least one adapter and move in consideration of the detected actual position into a receiving position that is suitable to independently receive the at least one adapter. The at least one sensor system can comprise a laser scanner, for example, via which laser scanner the at least one driverless transport vehicle can detect an actual position of the at least one adapter and move in consideration of the detected actual position into a receiving position that is suitable to independently receive the at least one adapter.

It is also possible that the at least one driverless transport vehicle has a plug and that the at least one adapter comprises a mating plug, which corresponds to the plug of the at least one transport vehicle. Via an actuator designed as part of the transport apparatus, it is in this context possible that the plug of the at least one driverless transport vehicle and the mating plug of the at least one adapter are pluggable into each other, whereby an electric and/or fluidic connection is producible between the at least one driverless transport vehicle and the at least one adapter.

It has proved successful, for example, for the at least one driverless transport vehicle to have an actuator, via which actuator the plug of the at least one driverless transport vehicle can be extended or moved upward in vertical direction. The at least one driverless transport vehicle can also have a lifting device, in which context the plug of the at least one driverless transport vehicle can be plugged into the mating plug of the at least one adapter by lifting the lifting device.

The transport apparatus can also comprise an actuating mechanism, via which actuating mechanism the particular supply roll being held via the at least one adapter that is preferably separably connected to the driverless transport vehicle can be moved relative to the driverless transport vehicle along an axis, which axis is oriented parallel or substantially parallel to a floor surface and perpendicular to a longitudinal axis of a particular supply roll.

The invention moreover relates to a packaging system used to package articles, such as beverage containers or the like. The embodiments of the above-described transport apparatus can be part of the packaging system according to the invention. Accordingly, all embodiments of the at least one transport vehicle already described above can be part of the packaging system according to the invention. Alternatively or additionally, all embodiments of the at least one adapter already described above can be part of the packaging system according to the invention.

The packaging system comprises at least one packaging apparatus, which can unwind packaging material from a supply roll, and which is designed to apply the packaging material unwound from the supply roll onto articles. The packaging apparatus can comprise at least one machine mandrel, which is designed to hold a supply roll in a clamping manner, and which is rotatingly movable to unwind the packaging material via the packaging apparatus.

In preferred embodiments, the packaging apparatus can comprise at least two machine mandrels, on which new supply rolls can be alternately positioned, if required. In order to connect packaging material of a new supply roll to packaging material already running in the packaging apparatus, the packaging apparatus can comprise a sealing bar, which brings the packaging material of the particular new supply roll into surface contact with the packaging material already accommodated in the packaging apparatus and which connects them to each other by temperature application.

The packaging system furthermore comprises at least one driverless transport vehicle, which interacts with the at least one packaging apparatus in feeding supply rolls to the packaging apparatus.

Moreover, at least one adapter is part of the packaging system, with the at least one adapter preferably designed to be separably connected to the at least one driverless transport vehicle and to hold at least one supply roll.

The packaging system can comprise a handling device preferably designed as articulated robot, the handling device being designed to deliver supply rolls, which are provided to be fed to the at least one packaging apparatus, to the at least one adapter that is preferably separably connected to the at least one driverless transport vehicle. It has proved successful for the handling device preferably designed as articulated robot to have a clamping mandrel, via which the handling device preferably designed as articulated robot can receive a supply roll and deliver it to the at least one driverless transport vehicle.

It is possible for the handling device preferably designed as articulated robot to be designed such that the handling device preferably designed as articulated robot can remove a packaging from supply rolls. Alternatively or additionally, it is possible for the handling device preferably designed as articulated robot to be designed such that the handling device preferably designed as articulated robot can check supply rolls for the presence of specified quality criteria and, if necessary, outputs a notification or a message if the detected quality criteria of a supply roll deviate from the specified quality criteria.

If necessary, the handling device can moreover receive another supply roll and deliver it to the at least one adapter that is preferably separably connected to the at least one driverless transport vehicle, with the other supply roll fulfilling the specified quality criteria.

The packaging system can also comprise at least one navigation aid, which has a preferably triangular geometry. In this context, the at least one driverless transport vehicle can have a sensor system, by which the at least one driverless transport vehicle can detect a position of the at least one navigation aid. Furthermore, the driverless transport vehicle can be designed to independently and in consideration of the position of the at least one navigation aid detected by the sensor system move toward a delivery position provided for a supply roll to be passed on to the at least one packaging apparatus.

The at least one driverless transport vehicle can thus be designed to independently deliver a supply roll to the at least one packaging apparatus via the at least one adapter. Such embodiments are characterized by a high degree of automation.

The invention moreover relates to a method to operate a packaging apparatus. Features described above regarding various embodiments of the packaging system according to the invention or regarding various embodiments of the transport apparatus according to the invention can likewise be provided for the below-described embodiments of the method according to the invention, and they are therefore not repeatedly mentioned.

Features described below regarding various embodiments of the method according to the invention can likewise be provided in each instance in the already described embodiments of the packaging system according to the invention and in the embodiments of the transport apparatus according to the invention. The packaging system already described above can be provided or designed to implement or carry out the embodiments of the below-described method, if applicable.

One step of the method according to the invention provides feeding at least one supply roll to at least one packaging apparatus with the help of a driverless transport vehicle.

In a further step, an unwinding of packaging material from the at least one supply roll is carried out, which supply roll was fed to the at least one packaging apparatus with the help of the at least one driverless transport vehicle. An application of the packaging material unwound from the supply roll onto articles is moreover carried out.

It is provided that, in order to feed the supply roll to the at least one packaging apparatus, at least one adapter is preferably separably, in other embodiments, however, also fixedly connected to the at least one driverless transport vehicle, whereupon the at least one driverless transport vehicle transports the at least one supply roll being held via the at least one adapter that is preferably separably connected to the at least one driverless transport vehicle along a defined transfer path to the at least one packaging apparatus, and whereupon the at least one supply roll transported to the at least one packaging apparatus is introduced into the at least one packaging apparatus.

It is possible in this context that the at least one supply roll transported to the at least one packaging apparatus is introduced into the at least one packaging apparatus via the at least one adapter that is preferably separably connected to the at least one driverless transport vehicle.

Embodiments have proved successful in which the at least one driverless transport vehicle independently moves toward the at least one adapter, and hereupon independently connects to the at least one adapter toward which it has moved.

It is also possible that the at least one driverless transport vehicle and/or the at least one adapter has a lifting mechanism, via which lifting mechanism the at least one adapter is lifted relative to the at least one driverless transport vehicle, with the at least one adapter losing its surface contact with a floor surface after the at least one driverless transport vehicle has moved toward the at least one adapter.

In particular, it is possible in this context that the at least one driverless transport vehicle first moves into a position in which the at least one driverless transport vehicle is situated below the at least one adapter, with the at least one driverless transport vehicle subsequently lifting the at least one adapter in this position via the lifting mechanism, whereby the at least one adapter loses its surface contact with the floor surface.

It is alternatively or additionally possible for the at least one driverless transport vehicle and the at least one adapter to form a centering mechanism together, via which centering mechanism the at least one adapter is aligned relative to the at least one driverless transport vehicle when the adapter is independently received via the at least one driverless transport vehicle.

It can alternatively or additionally be provided that the at least one driverless transport vehicle and the at least one adapter interact via a clamp bolt and a clamping mechanism, via which clamp bolt and clamping mechanism the at least one adapter and the at least one transport vehicle are connected.

It is furthermore possible that the at least one driverless transport vehicle has at least one sensor system, via which at least one sensor system the at least one driverless transport vehicle detects an actual position of the at least one adapter and moves in consideration of the detected actual position into a receiving position that is suitable to independently receive the at least one adapter.

It is also conceivable that the at least one adapter comprises at least one holding mandrel, which at least one holding mandrel in at least one working position receives at least one supply roll, which is provided to be fed to the at least one packaging apparatus, and is then transferred together with the at least one supply roll into the at least one driving position, such that, by the transfer of the at least one holding mandrel from the working position into the driving position, a center of gravity of the transport apparatus and of the at least one supply roll received by the transport apparatus is shifted toward a middle of the transport apparatus. In this context, the at least one holding mandrel can be situated in the at least one driving position during the transport of the at least one supply roll along the defined transfer path.

In particular, it can be provided in this context that the transfer of the at least one holding mandrel from the at least one working position into the at least one driving position is achieved by an actuatoric swivel movement of at least one support arm of the at least one adapter, on which at least one support arm the at least one holding mandrel is arranged. Alternatively or additionally, it is possible that the transfer of the at least one holding mandrel from the working position into the driving position is achieved by a movement of the at least one holding mandrel via at least one linear actuator.

It is conceivable that the at least one driverless transport vehicle has a plug and that the at least one adapter comprises a mating plug. The plug and the mating plug can correspond to each other. Via an actuator designed as part of the transport apparatus, it is in this context possible that the plug of the at least one driverless transport vehicle and the mating plug of the at least one adapter are plugged into each other or are plugged to each other, whereby an electric and/or fluidic or pneumatic and/or hydraulic connection is produced between the at least one driverless transport vehicle and the at least one adapter.

Additionally or alternatively, it is possible that the driverless transport vehicle and the at least one adapter are designed such that a connection between the driverless transport vehicle and the at least one adapter can be formed by induction in order to supply the at least one adapter with electric power.

It has also proved successful for at least one navigation aid, which has a preferably triangular geometry, to be arranged at a defined position in the range of the at least one packaging apparatus. In addition, the at least one driverless transport vehicle can have a sensor system, by which sensor system the at least one driverless transport vehicle detects a position of the at least one navigation aid, in which context the driverless transport vehicle moves toward a specific delivery position in consideration of the detected position of the at least one navigation aid, and in the delivery position then passes on at least one supply roll to the at least one packaging apparatus.

BRIEF DESCRIPTION OF THE FIGURES

In the following passages, the attached figures further illustrate typical embodiments of the invention and their advantages. The size ratios of the individual elements in the figures do not necessarily reflect the real size ratios. It is to be understood that in some instances various aspects of the invention may be shown exaggerated or enlarged in relation to other elements in order to facilitate an understanding of the invention.

DETAILED DESCRIPTION OF THE INVENTION

Figure 1:
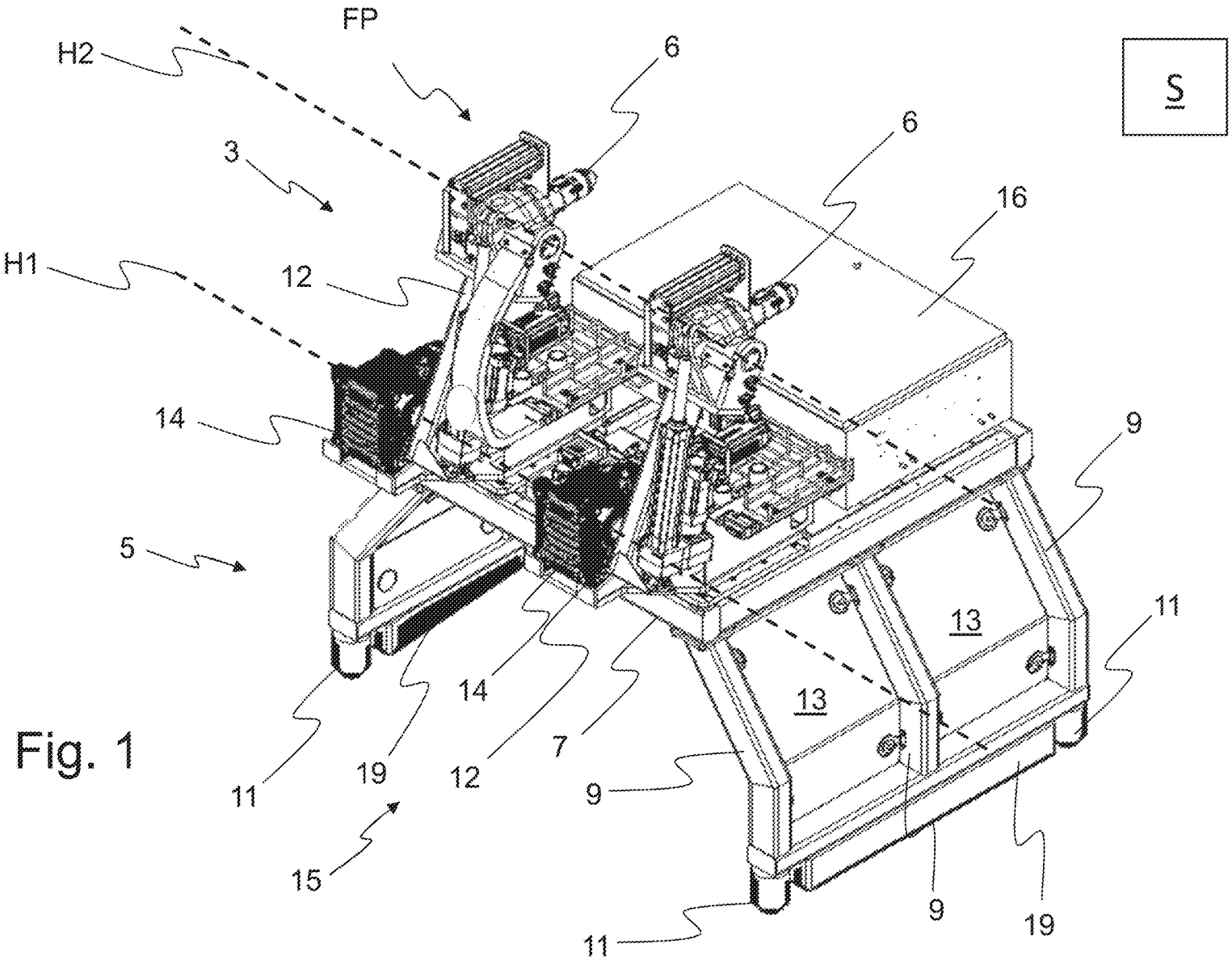
FIG. 1 shows a schematic perspective view of an embodiment of an adapter such as can be provided for various embodiments of the transport apparatus according to the invention.

The same or equivalent elements of the invention are designated using identical reference characters. Furthermore and for the sake of clarity, only the reference characters relevant for describing the individual figures are provided. It should be understood that the detailed description and specific examples, while indicating preferred embodiments, are intended for purposes of illustration only and are not intended to limit the scope of the invention.

The embodiments, examples and alternatives of the preceding paragraphs, the claims, or the following figures and description, including any of their various views or respective individual features, may be taken independently or in any combination. Features described in connection with one embodiment are applicable to all embodiments, unless such features are incompatible.

If illustrations and views are generally referred to as being "schematic" in the context of the following description of figures, this is by no means intended to imply that the illustrations of the figures and their description are of inferior significance with regard to the disclosure of the invention. The person skilled in the art is fully capable of gathering sufficient information from the schematically and abstractly drawn illustrations for facilitating the understanding of the invention without the understanding being in any way impaired by, for example, the size ratios being drawn and being potentially not precisely true to scale. On the basis of the more concretely explained realizations of the method according to the invention and on the basis of the more concretely explained functionality of the apparatus according to the invention in the figures, the reader as a person skilled in the art is thus enabled to derive a better understanding of the inventive idea, which is formulated in a more general and/or more abstract manner in the claims and in the general part of the description.

FIG. 1 shows a schematic perspective view of an embodiment of an adapter 3 such as can be provided for various embodiments of the transport apparatus 1 according to the invention. The adapter 3 comprises a supporting frame structure 5 with a top frame 7 and a plurality of cylindrical cores 9 arranged at the top frame 7. The adapter 3 furthermore has a plurality of support feet 11 connected to the frame structure 5, via which support feet 11 the adapter 3 stands on a floor surface.

As will be described below, the adapter 3 can be connected to the driverless transport vehicle 2, with the adapter 3 then being supported by the driverless transport vehicle 2. Covers 13 are arranged between the cylindrical cores 9 in order to prevent an unintentional contact with the driverless transport vehicle 2.

Figure 2:
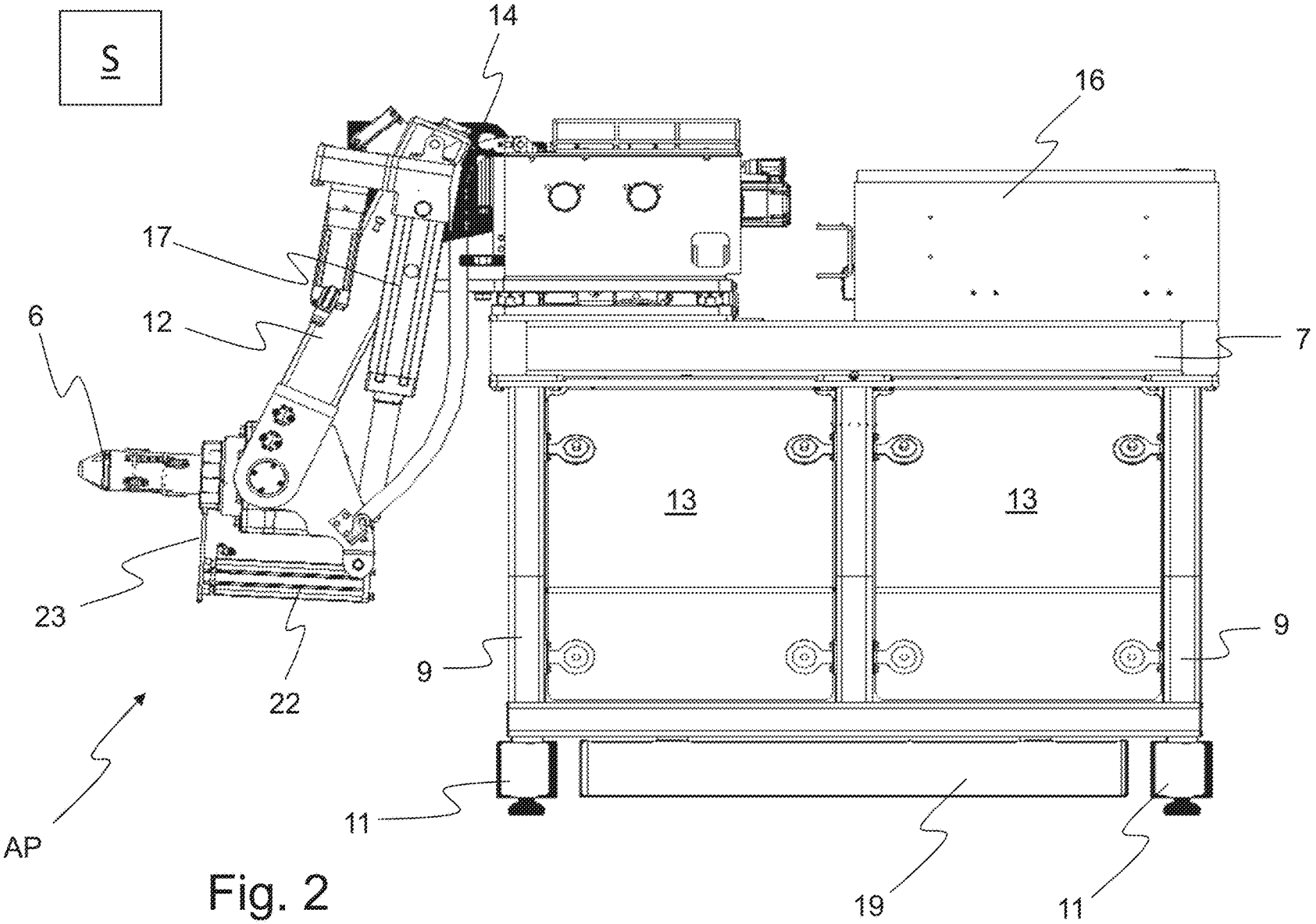
FIG. 2 shows a schematic side view of the embodiment of an adapter of FIG. 1.

The adapter 3 has two holding mandrels 6, which can each receive a supply roll 8 (cf. FIG. 6) in a clamping manner by enlargement of their particular cross-sectional diameter. A particular holding mandrel 6 is attached to a particular support arm 12. Each of the support arms 12 has an own actuator 14 assigned to it, so that the support arms 12, each together with the particular holding mandrels 6 arranged thereon, can be independently of one another swiveled about a horizontally oriented axis H1 upon actuation of the particular actuator 14. The actuators 14 are designed as electric motors. A swivel movement can in this context be carried out by an angle of 180° or at least approximately 180°. Such a swivel movement is illustrated by FIG. 1 and FIG. 2 seen in conjunction.

In order to hold a supply roll 8, it is also conceivable for other embodiments that a gripper, a prism, and/or an articulated robot, for example, is connected to the frame structure 5 instead of the holding mandrels 6. Embodiments with holding mandrels 6 have, however, proved successful in receiving supply rolls 8 in a simple manner.

The holding mandrels 6 in FIG. 1 are arranged in a driving position FP. In the position shown in FIG. 1, the adapter 3 can be driven or moved toward a packaging apparatus 20 (cf.

Figure 5:
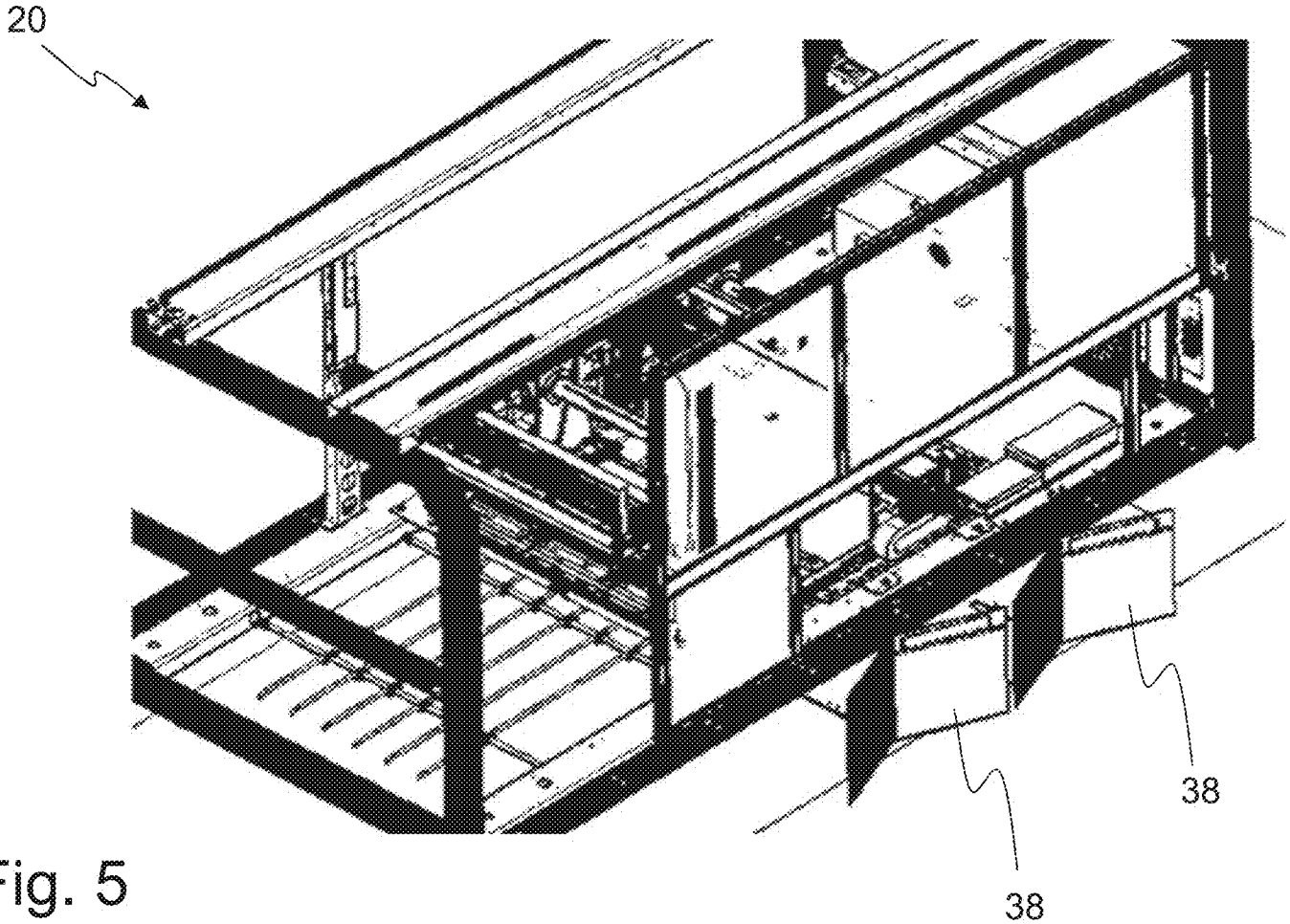
FIG. 5 shows a schematic perspective view of an embodiment of an packaging apparatus such as can be provided for various embodiments of the packaging system according to the invention.

FIG. 5) via a driverless transport vehicle 2. The holding mandrels 6 then take a position behind a lateral circumference of the driverless transport vehicle 2, so the transport apparatus 1 has a very compact form while being moved.

Since supply rolls 8 can have a relatively high mass, the arrangement of the holding mandrels 6 correspondingly to the driving position FP as shown in FIG. 1 with high probability prevents the transport apparatus 1 from being inadvertently overturned during a transport of a supply roll 8. If a supply roll 8 is situated on a holding mandrel 6, the center of gravity of the adapter 3 or of the transport apparatus 1 is shifted toward a middle of the adapter 3 when the holding mandrels 6 are moved from the working position AP of FIG. 2 into the driving position FP of FIG. 1, with the result that a supply roll 8 can be transported with high stability.

For the purpose of the receiving via a driverless vehicle 2, the driverless transport vehicle 2 is driven under the adapter 3, while the driverless transport vehicle 2 enters a tunnel 15 provided by the frame structure 5 of the adapter 3, as will be described further below. In this context it is also advantageous for the holding mandrels 6 to be situated in the driving position FP of FIG. 1, since the support arms 12 with their thereon arranged holding mandrels 6 block the entrance to the tunnel 15 on one side (cf. FIG. 2).

In order to be able to deliver a supply roll 8 arranged on a holding mandrel 6 to a packaging apparatus 20, the particular support arm 12 with the thereon arranged holding mandrel 6 and the particular supply roll 8 is swiveled into the working position of FIG. 2. Since the supply roll 8 has to be slid onto or delivered to a machine mandrel 60 (cf. FIG. 6) of a packaging apparatus 20 in a further step, it can first be necessary to transfer the particular holding mandrel 6 as well as the particular thereon arranged supply roll 8 into a horizontal orientation.

It is in this context discernible from each of the FIGS. 1 and 2 that each holding mandrel 6 has an own actuator cylinder 17 assigned to it, via which particular actuator cylinder the particular holding mandrel 6 can be swiveled about a further horizontally oriented axis H2. The actuator cylinders 17 can be formed by pneumatic cylinders or hydraulic cylinders, in preferred embodiments, however, by electric cylinders, and, together with a joint, they form a tilt mechanism for the particular holding mandrel 6.

Also, when receiving a new supply roll 8 via a holding mandrel 6, it can be necessary for the particular holding mandrel 6 to be previously swiveled via the particular actuator cylinder 17 and to be transferred into an orientation in which the longitudinal axis of the particular holding mandrel is oriented perpendicular or at least at least approximately perpendicular. Such an orientation of the holding mandrel 6 is illustrated in each of the FIGS. 10C and 10D.

Since an inaccurate alignment of the holding mandrel 6 can lead to problems when delivering a supply roll 8 to the packaging apparatus 20, and since an inaccurate alignment of the holding mandrel 6 can moreover lead to problems when receiving a new supply roll 8 via the particular holding mandrel 6, each holding mandrel 6 has a sensor assigned to it, which detects the particular actual tilt or position or orientation of the particular holding mandrel 6 relative to the particular support arm 12.

The particular sensor supplies information on the particular actual tilt, position, or orientation of the particular holding mandrel 6 to the control device and/or regulating device S designed as part of the transport apparatus 1. The control device and/or regulating device S can then check whether the particular detected actual tilt or position or orientation corresponds to a specified target tilt or position or orientation, and, if required, it can control the actuator cylinder 17 to correct the particular actual tilt or position or orientation if the particular detected actual tilt or position or orientation deviates from the specified target tilt or position or orientation. As a result, the particular actual tilt or position or orientation of the holding mandrel 6 corresponds very precisely with a specified target tilt or position or orientation, whereby a particular supply roll 8 can be safely delivered to a packaging apparatus 20, and whereby a particular holding mandrel 6 can accurately receive a new supply roll 8.

The working position AP of the support arm 12 can be varied in a specified angle range or tilt range. Corresponding conditions, for example an uneven floor surface, can hereby be compensated when delivering a supply roll 8 to a packaging apparatus 20 (cf. FIG. 5). Height differences in the range of 300 mm are common in practice.

Furthermore, the reference number 16 indicates a terminal box positioned on the top frame 7 of the frame structure 5. Electronic components that supply the actuators 14 with electric power are arranged in the terminal box 16. A control device and/or regulating device that can control the actuator cylinders 17, for example, is moreover arranged inside the terminal box 16.

The schematic side view of FIG. 2 moreover shows a support arm 12 arranged on the pressure cylinder 22, which can move a pressure plate 23 back and forth in linear direction and parallel to the longitudinal extension of the holding mandrel 6. Under surface contact with the pressure plate 23, it is thus possible to slide a supply roll 8 or a hollow cylindrical core 9 (cf. FIG. 11F) of an already depleted supply roll positioned on the holding mandrel 6 off of the holding mandrel 6, if applicable.

A control of the pressure cylinder 22 is moreover carried out via the control device and/or regulating device S designed as part of the transport apparatus. The pressure plate 23 is retracted via the pressure cylinder 22 into the position shown in FIG. 2 when a new supply roll 8 is received.

In order to be able to receive the adapter 3 via a driverless transport vehicle 2, it is necessary that the driverless transport vehicle 2 can move precisely and collision-free into the tunnel 15 (cf. FIG. 1) of the adapter 3. The adapter 3 therefore has two reference bars 19, which each have a triangular geometry and which are arranged between two support feet 11 of the adapter 3 in the present context. The driverless transport vehicle 2 can detect a position of the adapter 3 by sensor-detection of the reference bars 19, and it can thus move precisely into the tunnel 15 provided by the adapter 3. It can be helpful in this context for the driverless transport vehicle 2 to reduce its previous movement speed when entering the tunnel 15.

Figure 3:
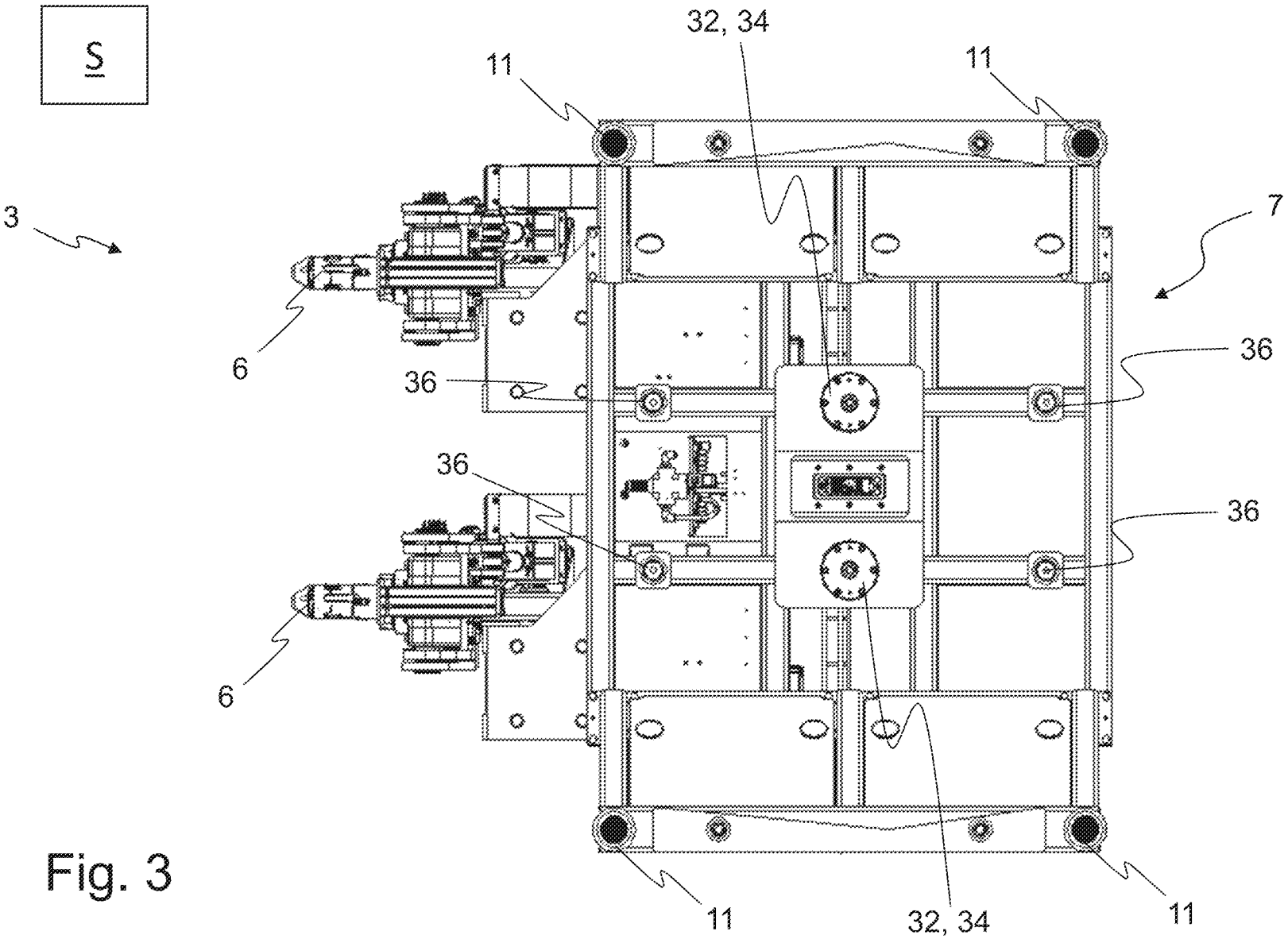
FIG. 3 shows a view from below of the embodiment of an adapter of the FIGS. 1 to 2.

The schematic illustration of FIG. 3 shows a view from below of the embodiment of an adapter 3 of the FIGS. 1 and 2. In order to arrange the adapter 3 on the driverless transport vehicle 2, it is necessary to mechanically couple the adapter 3 to the driverless transport vehicle 2 and to produce an electric connection between the adapter 3 and the driverless transport vehicle 2.

In order to receive the adapter 3 via the transport vehicle 2, the driverless transport vehicle 2 first moves into the tunnel 15 provided by the adapter 3, as mentioned above. As will be described in more detail below, the driverless transport vehicle 2 subsequently lifts the adapter 3, whereby the support feet 11 lose their surface contact with a floor surface. In order to be able to move the adapter 3 steadily via the driverless transport vehicle 2 and in order for the adapter to then be able to operate reliably, it is necessary for the adapter, which is then being supported by the driverless transport vehicle 2, to be situated very precisely in a specified position relative to the driverless transport vehicle 2.

The adapter 3 therefore has a plurality of centering bolts 36 which dip into corresponding centering bushings 56 (cf. FIGS. 4A and 4B) of the driverless transport vehicle 2 if the adapter 3 is lifted via the driverless transport vehicle 2. The adapter 3 is hereby aligned with the driverless transport vehicle 2 and is subsequently situated precisely in a specified relative position to the driverless transport vehicle 2.

In this context it has also proved successful for the control device and/or regulating device S to be designed such that it can detect when the centering bolts 36 have dipped into the centering bushings 56. It can be provided in this context that the control device and/or regulating device S allows a movement of the driverless transport vehicle 2 only in the instance of having detected that the centering bolts 36 have dipped into the centering bushings 56. In this way it can be prevented that the driverless transport vehicle 2 is moved toward a packaging apparatus 20 in order to supply the packaging apparatus 20 with supply rolls 8 if a received adapter 3 is improperly positioned on the driverless transport vehicle 2.

Via the centering bolts 36 dipping into the centering bushings 56, it is accordingly possible to detect, whether the adapter 3 is positioned on the driverless transport vehicle 2 The detection of a relative position of the adapter 3 relative to the driverless transport vehicle 2 can furthermore be carried out by the reference bars 19.

Problems associated herewith in an improper delivery of a supply roll 8 to the packaging apparatus 20, which can be caused by an adapter 3 positioned in an inaccurate orientation on the driverless transport vehicle 2, can hereby be excluded.

In order to fix the adapter 3 to the driverless transport vehicle 2 subsequently or after the adapter 3 has entered the tunnel 15, the adapter 3 moreover has a plurality of coupling media 32, which are each designed as clamp bolts 34. The coupling media 32 or the clamp bolts 34 interact with a clamping mechanism 58 of the driverless transport vehicle 2; the clamping mechanism 58 is shown in the FIGS. 4A and 4B.

Figure 4B:
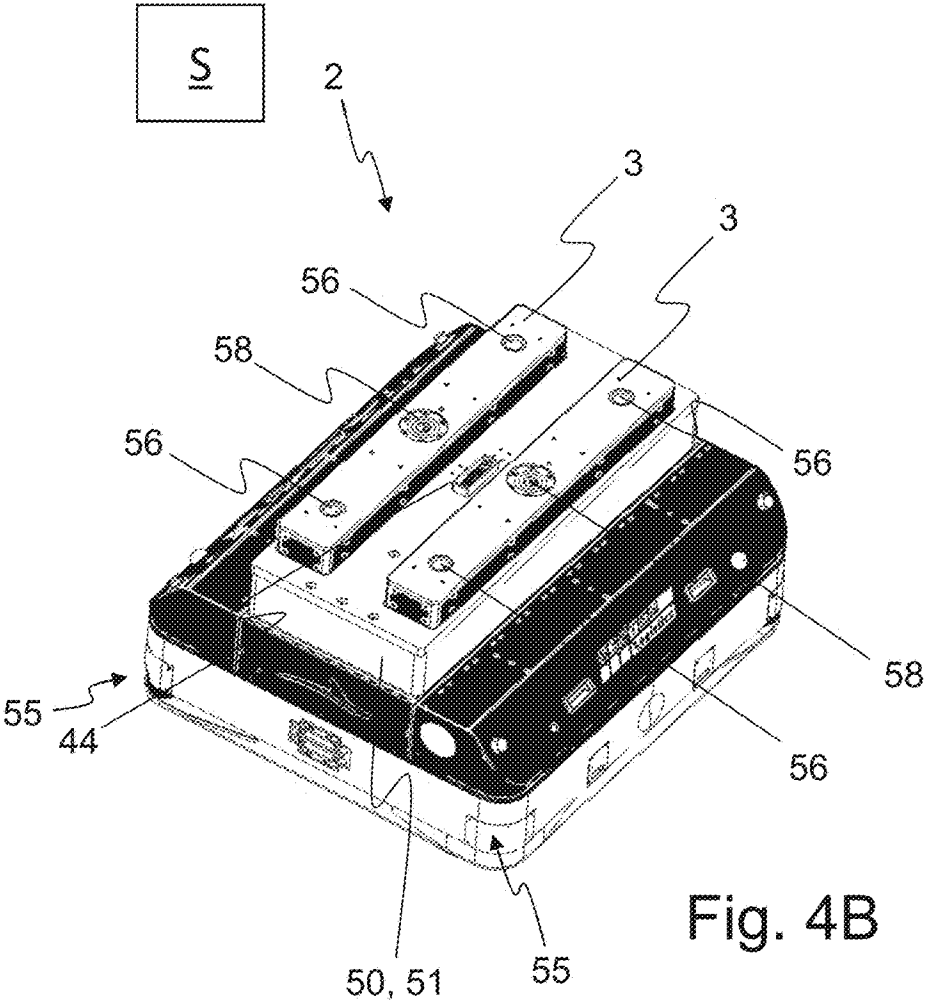
FIGS. 4A and 4B show a schematic perspective view of an embodiment of a driverless transport vehicle such as can be provided for various embodiments of the transport apparatus according to the invention.
Figure 4A:
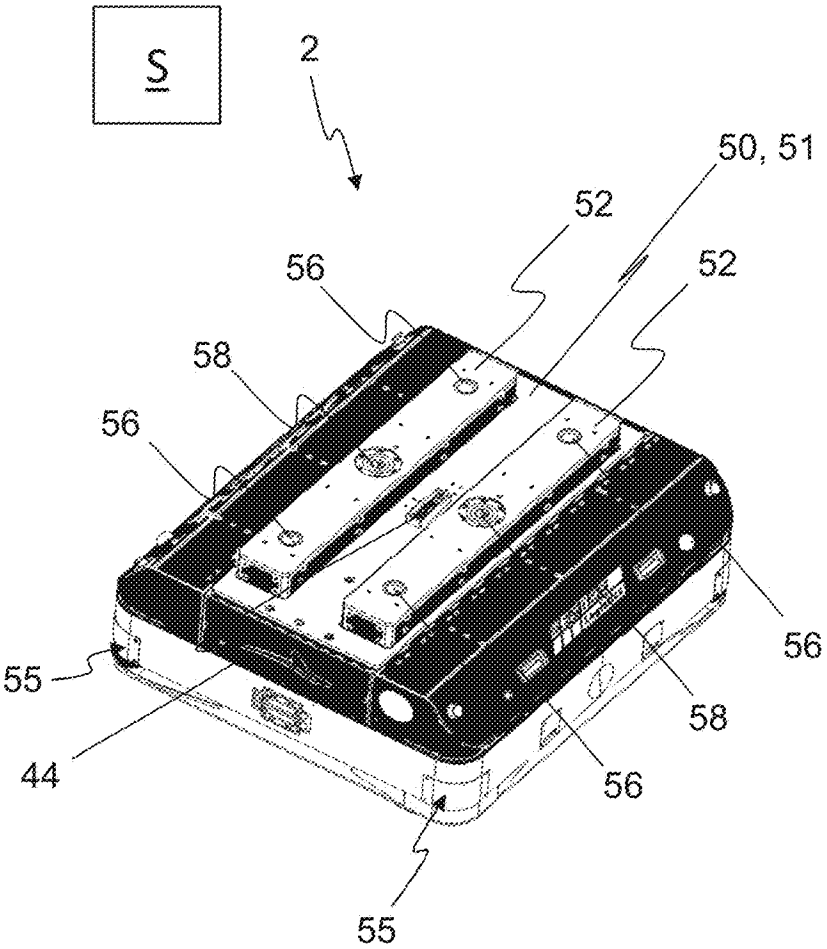

The adapter 3 can be fixed in an immovable and clamping manner to the driverless transport vehicle 2 via the two clamp bolts 34 illustrated in FIG. 3 and via the two clamping mechanisms illustrated in the FIGS. 4A and 4B. A corresponding actuation of the particular clamping mechanism 58 can furthermore be specified via the control device and/or regulating device S, so no manual intervention is necessary for the mechanical connection of the adapter 3 to the driverless transport vehicle 2.

In this context, embodiments have proved successful in which the control device and/or regulating device S enables a connection between the adapter 3 and the driverless vehicle 2 only after the control device and/or regulating device S has already detected that the centering bolts 36 have already dipped into the centering bushings 56.

On the underside of the adapter 3, there is moreover a mating plug 46, which is plugged into a corresponding plug 44 of the driverless transport vehicle 2 when the adapter 3 is received via the driverless transport vehicle 2. It is hereby possible to produce an electrical connection between the driverless transport vehicle 2 and the adapter 3. In the present context, the plug 44 of the driverless transport vehicle 2 is adjusted or lifted in vertical direction via a pneumatic cylinder (not illustrated here) in order to be plugged into the mating plug 46 of the adapter 3. After connecting the plug 44 of the driverless transport vehicle 2 to the mating plug 46 of the adapter 3, the driverless transport vehicle 2 can supply the adapter 3 with electric power via this plug connection.

It is also conceivable for further embodiments that the transport apparatus 1 has no such plug connection. The adapter 3 can also be supplied with electric power in an inductive manner, for example. A transfer of operating instructions from the driverless transport vehicle 2 to the adapter 3 can also be carried out in a wireless manner or via radio, where appropriate. It is also possible in other embodiments that the plug 44 and the mating plug 46 are plugged into each other as a result of the adapter 3 being lifted via the transport vehicle 2.

FIGS. 4A and 4B each show a schematic perspective view of an embodiment of a driverless transport vehicle 2 such as can be provided for various embodiments of the transport apparatus 1 according to the invention. In order to detect the reference bars 19, the driverless transport vehicle 2 has two sensor systems 55, which can be arranged in the area of two corner areas of the driverless transport vehicle 2 and which can be designed as laser scanners, for example. Such laser scanners can be safety laser scanners designed for the driverless transport vehicle 2.

Arranged on a top side of the driverless transport vehicle 2 are two receiving bars 52, which are connected to a lifting mechanism 51 or to a lifting unit 50.

The FIGS. 4A and 4B seen in conjunction illustrate a working movement of the driverless transport vehicle 2, in which the lifting unit 50, or the lifting mechanism 51, as applicable, is lifted together with the receiving bars 52. This working movement is carried out via the driverless transport vehicle 2 after entering the tunnel 15 of the adapter 3, in which context the adapter 3 moves upward along with the lifting unit 50 in the movement of the lifting unit 50. As soon as the receiving bars 52 come into surface contact with the adapter 3, such a contact is detected by the control device and/or regulating device. When the adapter 3 is lifted, the support feet 11 lose their surface contact with a floor surface.

FIG. 5 shows a schematic perspective view of an embodiment of an packaging apparatus 20 such as can be provided for various embodiments of the packaging system 100 (cf. FIG. 11) according to the invention. The packaging apparatus 20 can be used to unwind packaging material or film material from supply rolls 8 and to subsequently apply it onto articles.

In order for the packaging apparatus 20 to be able to apply packaging material or film material onto articles, the packaging apparatus 20 needs to be fed with supply rolls 8 at regular intervals when the supply of film material or packaging material of a supply roll 8 already situated in the packaging apparatus 20 is depleted or nearly depleted. A transport apparatus 1 is provided in order to feed supply rolls 8 to the packaging apparatus 20, the transport apparatus 1 comprising a driverless transport vehicle 2 and an adapter 3. The transport apparatus 1 can feed supply rolls 8 to the packaging apparatus 20 according to the steps as illustrated below with the FIGS. 12A to 12E.

FIG. 5 moreover shows that two navigation aids 38 having a triangular geometry are positioned in a vicinity of the packaging apparatus 20. The packaging apparatus 20 has two machine mandrels 60 via each of which the packaging apparatus 20 can unwind packaging material from a supply roll 8. Each machine mandrel 60 has a navigation aid 38 assigned to it. By the above-described sensor system 55, the driverless transport vehicle 2 can detect a position of the navigation aids 38, and can thus move together with the received adapter 3 precisely toward a position that is suitable to deliver a supply roll 8 to the packaging apparatus 20. The movement of the driverless transport vehicle 2 is thus carried out with the help of a sensor detection, in which a position of the navigation aids 38 is used as reference.

Figure 6:
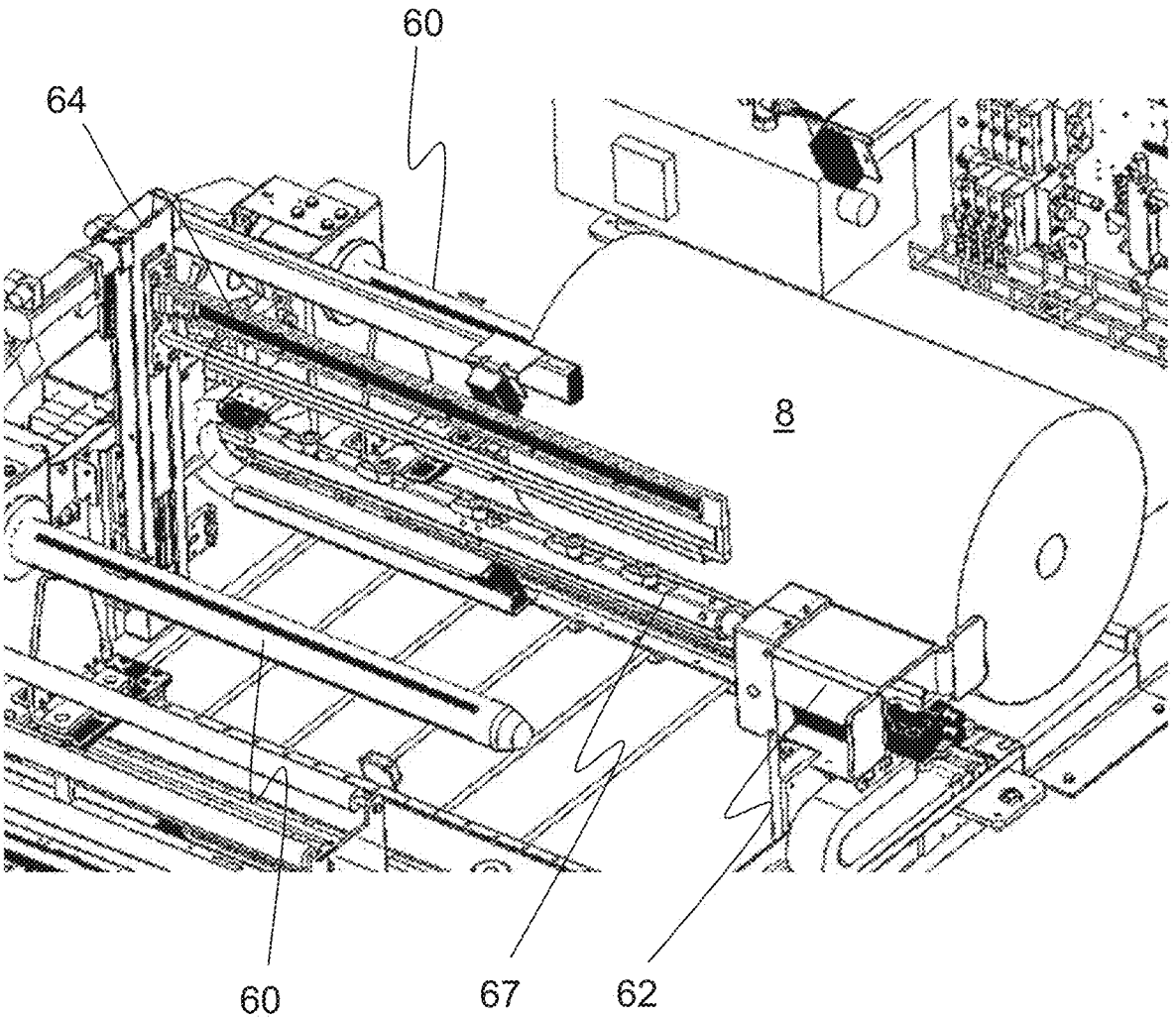
FIG. 6 shows individual details of the embodiment of a packaging apparatus of FIG. 5.

The perspective view of FIG. 6 shows individual details of the embodiment of a packaging apparatus 20 according to FIG. 5. As mentioned above, the packaging apparatus 20 has two machine mandrels 60 on which a supply roll 8 can in each instance be positioned. If a supply of packaging material from one supply roll 8 is depleted, the packaging material from the supply roll 8 arranged on the other machine mandrel 60 can be unwound, with the result that a packaging process can be operated without interruption or with only a brief interruption.

The packaging apparatus 20 comprises a suction shaft 67 to extract packaging material or a free end section of packaging material from a new supply roll 8. The suction shaft 67 can seize the particular free end section via negative pressure and can then move along beneath the sealing bar 64 together with the free end section. In order to connect the extracted free end section of packaging material from the new supply roll 8 to packaging material that is already accommodated in the packaging machine 20, the sealing bar 64 is subsequently moved downward in vertical direction, in which context the sealing bar 64 guides the extracted free end section against the packaging material already accommodated in the packaging machine and applies temperature to it. The extracted free end section of packaging material of the new supply roll 8 is hereby connected or heat-sealed to the packaging material that is already accommodated in the packaging apparatus 20.

The new roll 8 discernible in the illustration of FIG. 6 is not yet completely slid onto the machine mandrel 60 assigned to it. The transport apparatus 1 or the adapter 3 of the transport apparatus 1 has previously positioned the new supply roll 8 on the machine mandrel 60 assigned to it and has already moved away from the new supply roll 8. In order to slide the new supply roll 8 completely or up to a stop onto the machine mandrel 60, the packaging apparatus comprises an insertion plate 62.

In FIG. 6, the insertion plate 62 is already in surface contact with a front side of the new supply roll 8. By an axial movement of the insertion plate 62 parallel to the longitudinal axes of the machine mandrels 60, the insertion plate 62 can slide the new supply roll 8 that is already positioned on the assigned machine mandrel 60 against the stop of the machine mandrel 60, whereby the new supply roll 8 comes to be situated in a position in the packaging apparatus 20 provided for unwinding the packaging material or film material.

It is alternatively conceivable that the insertion plate 62 remains in its position and that the machine mandrel 60 is moved in axial direction together with the supply roll 8 positioned on it, whereby the already positioned supply roll 8 is slid against stop. It is also possible that the insertion plate 62 can alternate between the machine mandrels 60 so that the insertion plate 62 can slide supply rolls 8 onto both machine mandrels 60. In this context it has proved successful for the insertion plate 62 to be mechanically connected to the suction shaft 67.

Figure 7:
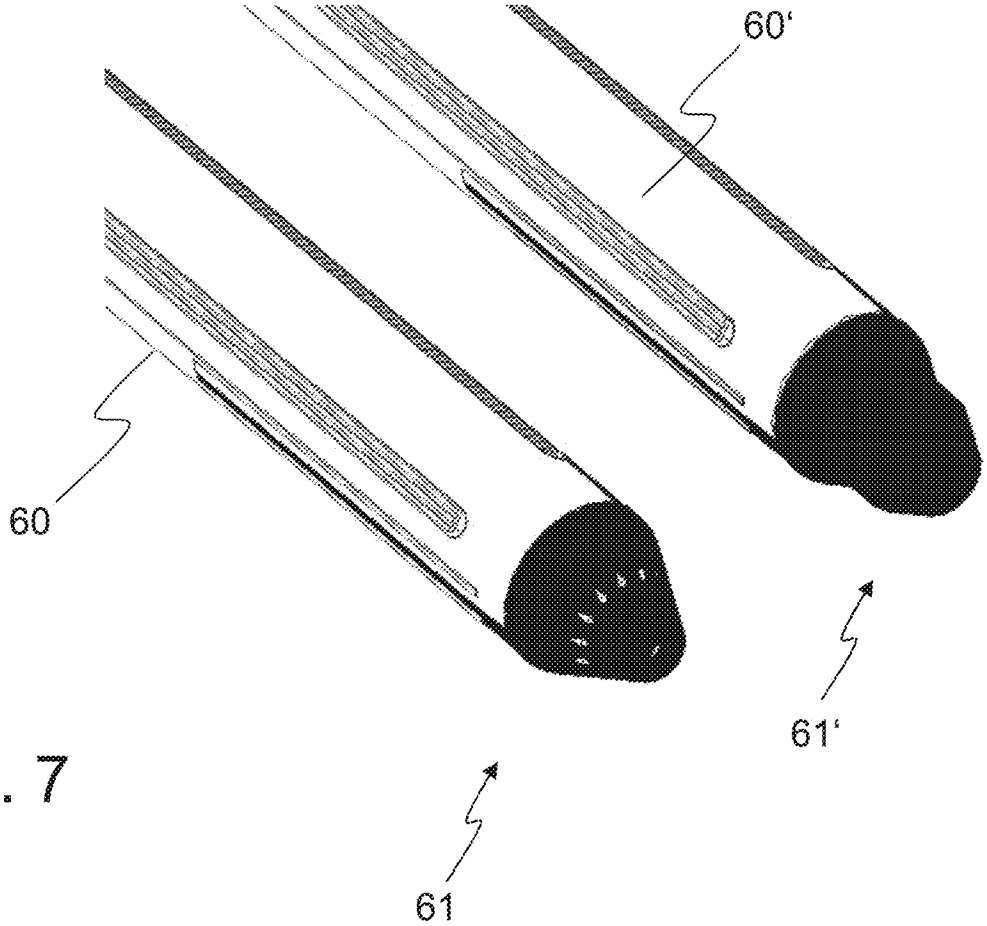
FIG. 7 shows two alternative embodiments of a machine mandrel such as can be provided as a part of various embodiments of the packaging apparatus.

The perspective view in FIG. 7 shows two alternative embodiments of a machine mandrel 60 and 60' such as can be provided as part of various embodiments of the packaging apparatus 20. The machine mandrel 60 is a preferred embodiment such as can be provided for the packaging apparatus 20.

The free end 61 of the machine mandrel 60 (FIG. 7, left side) is designed to be conical, whereby a new supply roll 8 can be reliably slid onto the machine mandrel 60 even if the supply roll 8 meets inaccurately with the machine mandrel 60.

The free end 61' of the machine mandrel 60' (FIG. 7, right side), is designed to be acorn-shaped and tapers in sections, or it can be designed to be cylindrical, where appropriate. The machine mandrel 60 with its conical free end 61 is part of the exemplary embodiment of a packaging apparatus 20 from the FIGS. 5 and 6.

FIGS. 8A to 8D each show an embodiment of a transport apparatus 1 according to the invention, and they illustrate individual steps such as can be provided in various embodiments of the method according to the invention.

The transport apparatus 1 furthermore comprises a driverless transport vehicle 2 as well as an adapter 3, which adapter 3 is not yet attached to the driverless transport vehicle 2. The adapter 3 has two holding mandrels 6, which can each hold one supply roll 8. The adapter 3 can thus hold a supply roll 8 until the supply roll 8 is delivered to a packaging apparatus 20.

Figure 8A:
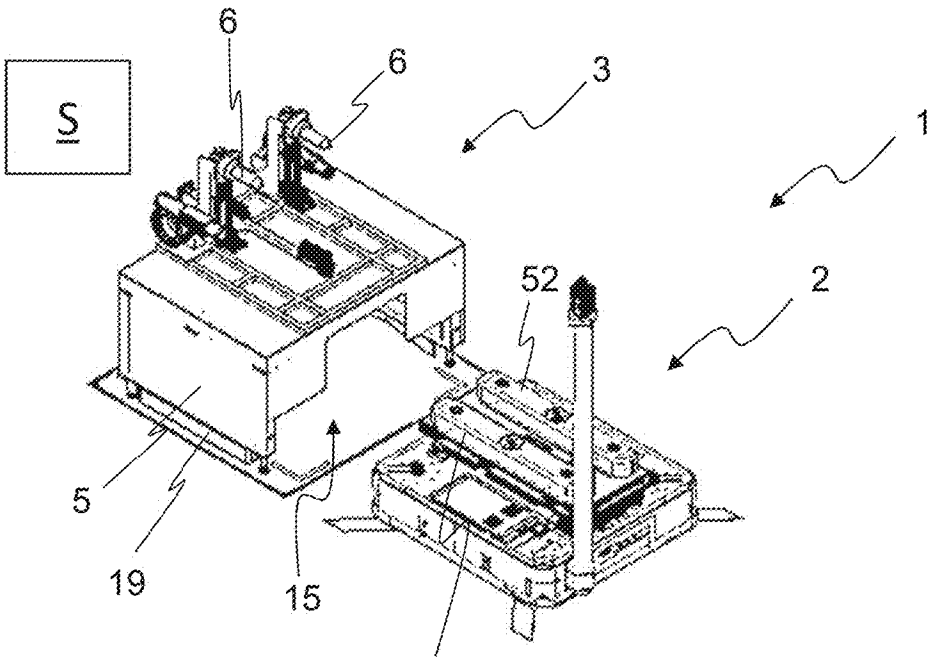
FIGS. 8A to 8D show an embodiment of a transport apparatus according to the invention and illustrate individual steps such as can be provided in various embodiments of the method according to the invention.
Figure 8B:
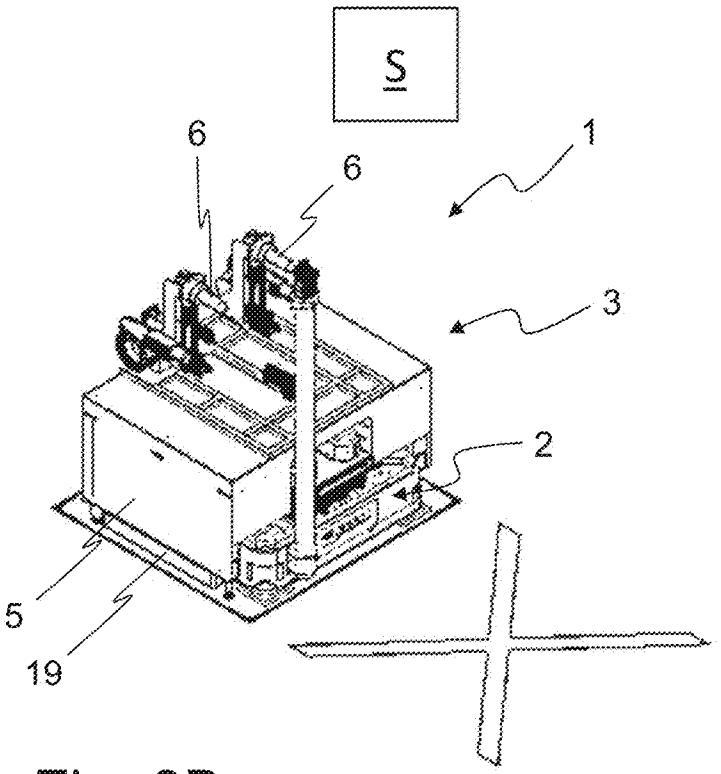

The FIGS. 8A and 8B seen in conjunction illustrate the driverless transport vehicle 2 moving into a tunnel 15 of the adapter 3 in order to receive the adapter 3. The defined movement of the driverless transport vehicle 2 into the tunnel 15 of the adapter 3 can furthermore be carried out with the help of a detection of the particular position of reference bars 19 via a sensor system 55 forming a part of the driverless transport vehicle 2 (cf. FIGS. 4A and 4B).

It is also possible for the driverless transport vehicle 2 to move into the tunnel 15 of the adapter 3 with the help of a laser navigation and reflector markers and/or with the help of data for a two-dimensional map stored in a control device and/or regulating device S forming a part of the transport apparatus 1. The driverless transport vehicle 2 can reduce its previous speed when entering the tunnel 15 in order to further minimize the risk of an inadvertent collision with the adapter 3.

In the view of FIG. 8B, the driverless transport vehicle 2 is now situated in a position in which the driverless transport vehicle 2 can receive the adapter 3.

A lifting unit 50 of the driverless transport vehicle 2 is lifted and in this context comes into surface contact with the adapter 3, as already described above for the FIGS. 4A and 4B. The FIGS. 8B and 8C seen in conjunction illustrate this method step. Immediately upon contact of the receiving bars 52 arranged on the lifting unit 50 and the adapter 3, the control device and/or regulating device S can condition the further lifting on an approval of a security query sent to the control device and/or regulating device S. In the context of such a security query, the control device and/or regulating device can check, for example, if the centering bolts 36 are each arranged in their particular centering bushings 56 and/or if the adapter 3 is fixed to the driverless transport vehicle 2 via the clamp bolts 34 and the clamping mechanism 58.

The control device and/or regulating device S can thus check the presence of further parameters, such as a specified relative position of the driverless transport vehicle 2 in relation to the adapter 3, and can cause or prevent a lifting of the adapter 3 depending on the result determined in the context of the particular check. It is also possible for the control device and/or regulating device S to have a display designed as touch screen, via which a user can approve a lifting of the adapter 3 via the driverless transport vehicle 2. In preferred embodiments, however, the receiving and connection between the driverless transport vehicle 2 and the adapter 3 is carried out in a completely automated manner, so a manual intervention is usually not necessary.

Figure 8C:
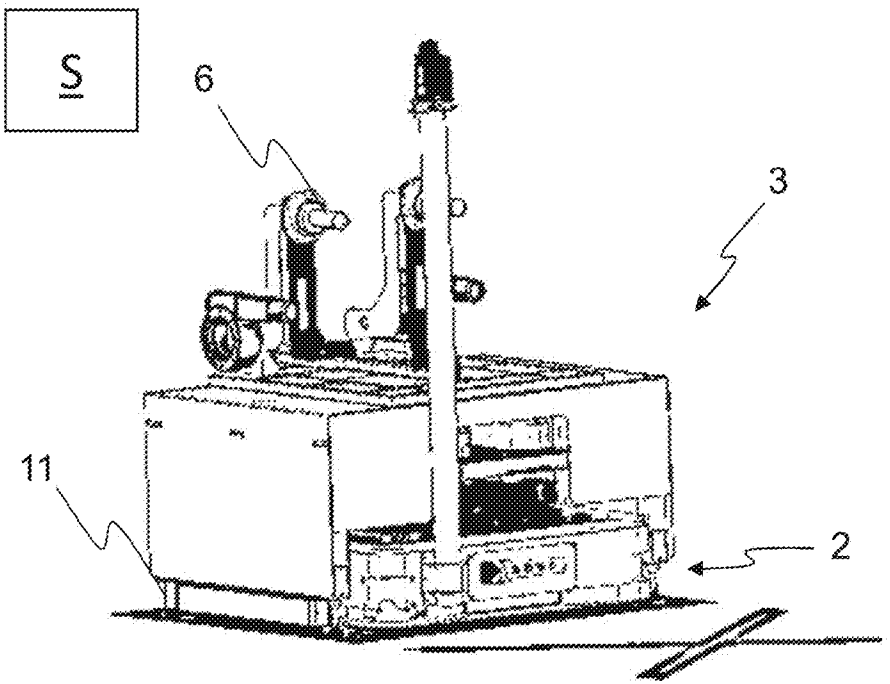
Figure 8D:
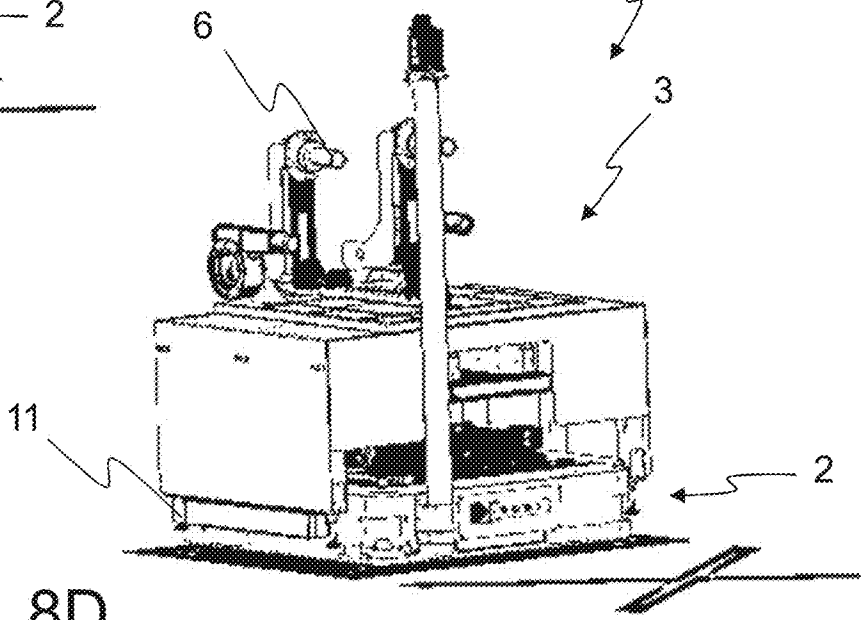

The lifting or receiving of the adapter 3 via the driverless transport vehicle 2 is discernible from FIGS. 8C and 8D seen in conjunction. In this context, the support feet 11 lose their surface contact with the floor surface. In practice, the driverless transport vehicle 2 can have laser scanners by which the driverless transport vehicle 2 navigates in a movement toward the packaging apparatus 20, whereby the safety conditions for users can simultaneously be ensured.

These laser scanners can be arranged on one or two opposite sides of the driverless transport vehicle 2 or in a corner area of the driverless transport vehicle 2, as illustrated above. Lifting the adapter 3 relative to a floor surface can be carried out in such a manner that these laser scanners are no longer covered by the adapter 3 after the adapter 3 has been lifted, with the result that the driverless transport vehicle 2 can also continue to navigate when holding an adapter 3.

Figure 9:
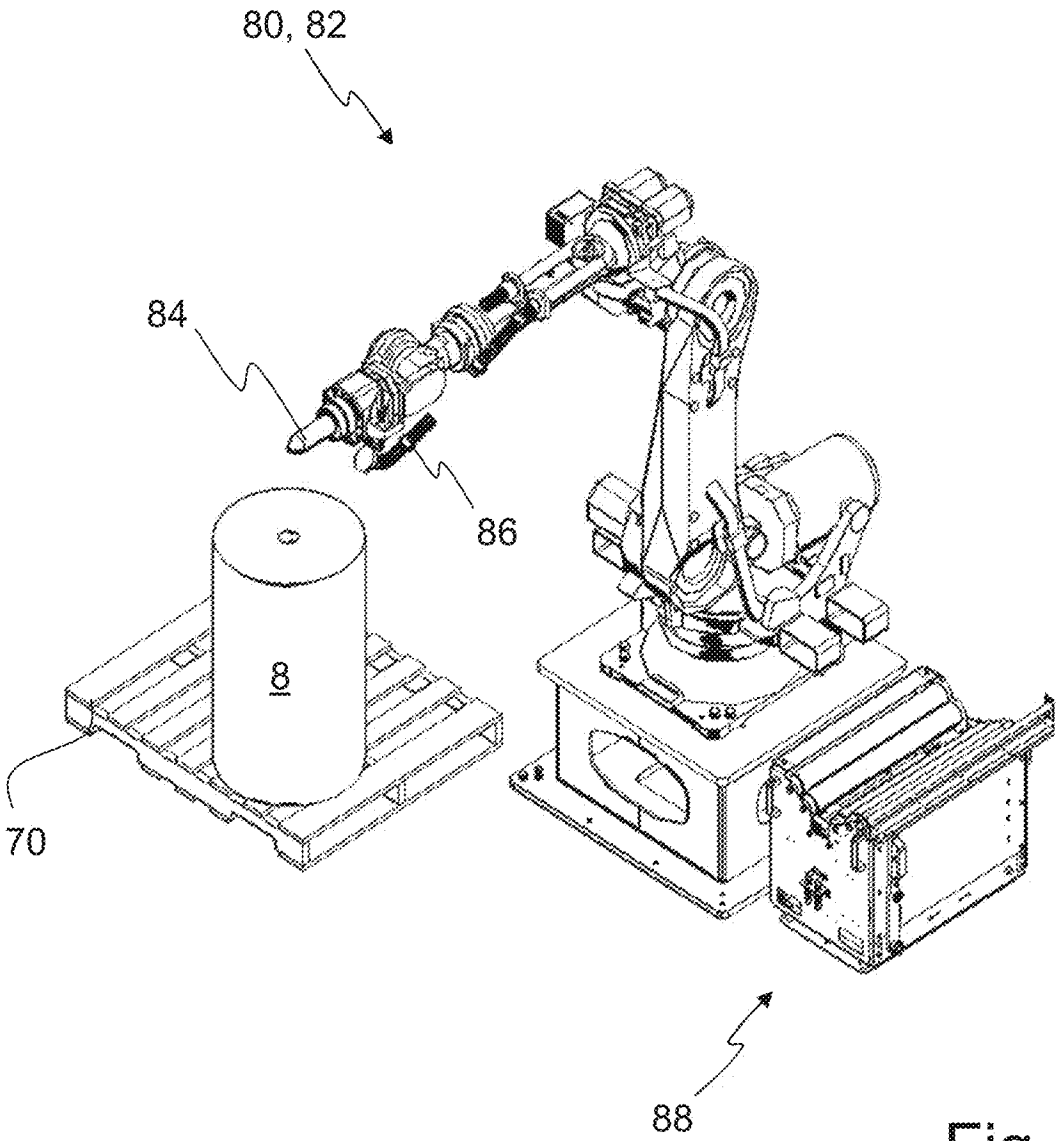
FIG. 9 shows a handling device such as can be provided as a part of various embodiments of the packaging system according to the invention.

The schematic perspective view of FIG. 9 shows a handling device 80 such as can be provided as part of various embodiments of the packaging system 100 according to the invention (cf. FIG. 11). The handling device 80 is designed as an articulated robot 82 or, in the present context, as a robot with serial kinematics or as a 6-axis robot. The handling device 80 or the articulated robot 82 can receive a new supply roll 8 from a pallet 70 via a clamping mandrel 84 forming part of the handling device 80 or articulated robot 82.

A delivery to the transport apparatus 1 can in this context be carried out according the description for the following FIGS. 10A to 10F. In order to be able to precisely detect the supply roll 8, the handling device 80 or the articulated robot 82 can have a camera system 86 via which the handling device 80 or the articulated robot 82 can detect a position of the supply roll 8 and move the clamping mandrel 84 according to the detected position.

Via the camera system 86, it is also possible to determine if the supply roll 8 is damaged. In such a case, the handling device 80 will not receive the damaged supply roll 8, and instead seize another supply roll that complies with specified characteristics or that is not damaged.

It is also possible for the handling device 80 or the articulated robot 82 to be equipped with a tool change system in order to fulfill tasks going beyond the handling of supply rolls 8. It is also possible in practice for the handling device 80 or the articulated robot 82 to be surrounded by a safety device, for example by a fence, which protects the handling device 80 or the articulated robot 82 from an unintentional contact caused by an operator.

The safety device or the fence can have a lock, a gate or a roller shutter, through which the driverless transport vehicle 2 with the thereto attached adapter 3 enters into the vicinity of the handling device 80 or of the articulated robot 82.

It is also possible for the handling device 80 or the articulated robot 82 to have a sensor system, via which sensor system the handling device 80 or the articulated robot 82 detects the approach of an operator. The handling device 80 or the articulated robot 82 can then independently block a further movement and, in particular, can independently shut off.

Moreover shown in FIG. 9 is a turning station 88. In a delivery of the supply roll 8 to the packaging apparatus 20, it is necessary for the supply roll 8 to be delivered to the packaging apparatus 20 with a specified direction of rotation or in a rotation-direction-conforming manner. The handling device 80 can detect the particular direction of rotation by the camera system 86.

If the particular direction of rotation does not correspond to the specified target direction of rotation, the handling device 80 or the articulated robot 82 can deposit the already received supply roll 8 on the turning station 88 and then take it up again from an opposite side, so that the particular direction of rotation in the packaging apparatus 20 corresponds to a specified target direction of rotation, or so that the handling device 80 or the articulated robot 82 can deliver the supply roll 8 held via the clamping mandrel 84 to the transport apparatus 1 with a specified direction of rotation.

It can moreover be possible for a packaging system 100 to comprise a plurality of packaging apparatuses 20, which are fed with supply rolls 8 by exactly one transport apparatus 1 or also by a plurality of transport apparatuses 1. In such embodiments, the handling device 80 can pass on supply rolls 8 to the exactly one transport apparatus 1 or to the plurality of transport apparatuses 1. If required, a coordination or control of the handling device 80 and of the plurality of transport apparatuses can be carried out by a control system or by a central computer unit.

The schematic perspective views of FIGS. 10A to 10F show a supply roll 8 being received via a transport apparatus 1 such as can be carried out in various embodiments of the method according to the invention. A handling device 80 designed as an articulated robot 82, which is already shown and described in FIG. 9, is furthermore provided In the embodiment of the FIGS. 10A to 10F. FIG. 9 is therefore referred back to regarding the detailed design of the handling device 80 or the articulated robot 82.

Figure 10B:
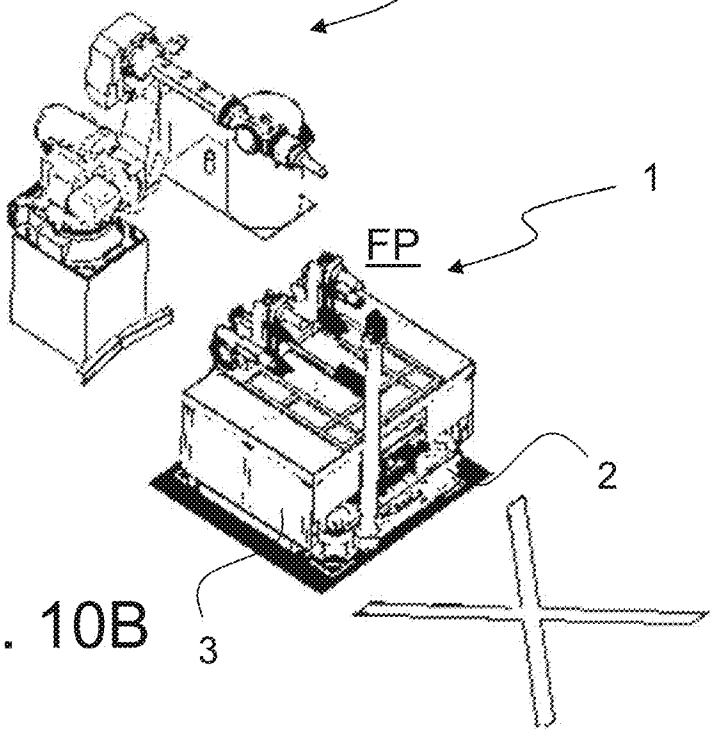
FIGS. 10A to 10F show a supply roll being received via a transport apparatus such as can be carried out in various embodiments of the method according to the invention.
Figure 10A:
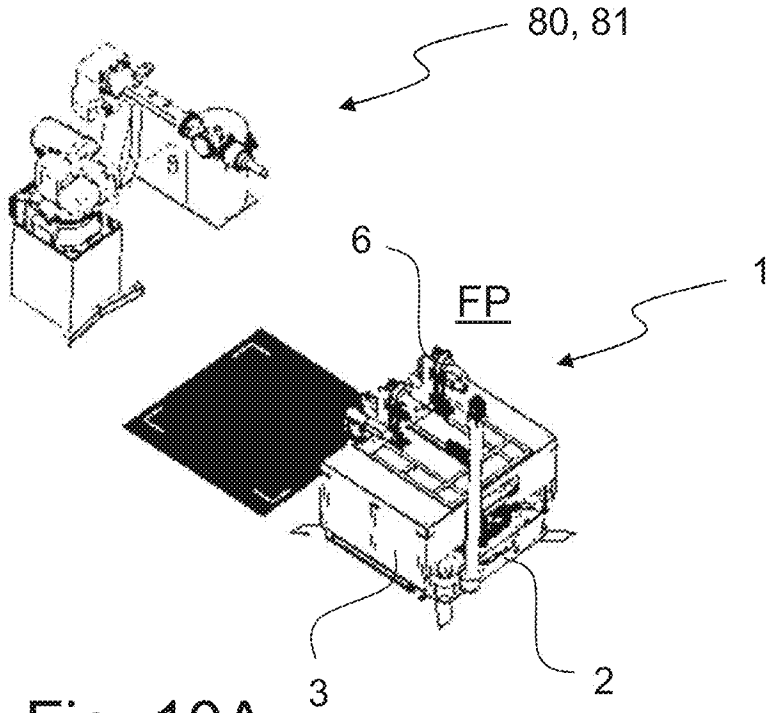

The FIGS. 10A and 10B seen in conjunction illustrate the transport apparatus 1 moving to the handling device 80 in a first step and stopping there at a specified position that is suitable to receive a supply roll 8. The movement or the navigation of the transport apparatus to this position can furthermore be carried out with the help of a sensor system 55 or by laser navigation.

In the exemplary embodiment of FIGS. 10, the handling device 80 or the articulated robot 82 has a triangular geometry in the area of its base, via which triangular geometry the transport apparatus can sensor-detect a position of the handling device 80. It can be provided in other embodiments that the transport apparatus 1 has a camera by which the transport apparatus can detect a position of a supply roll 8.

Figure 10C:
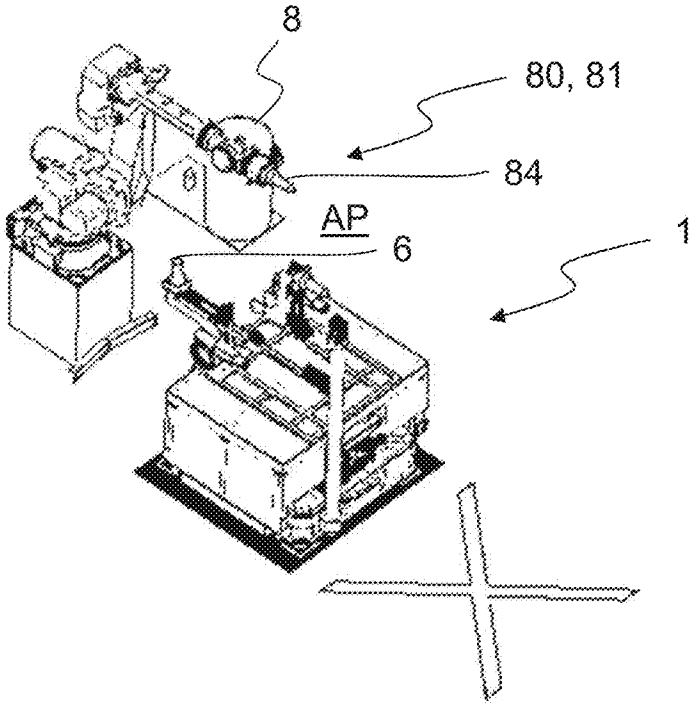
Figure 10D:
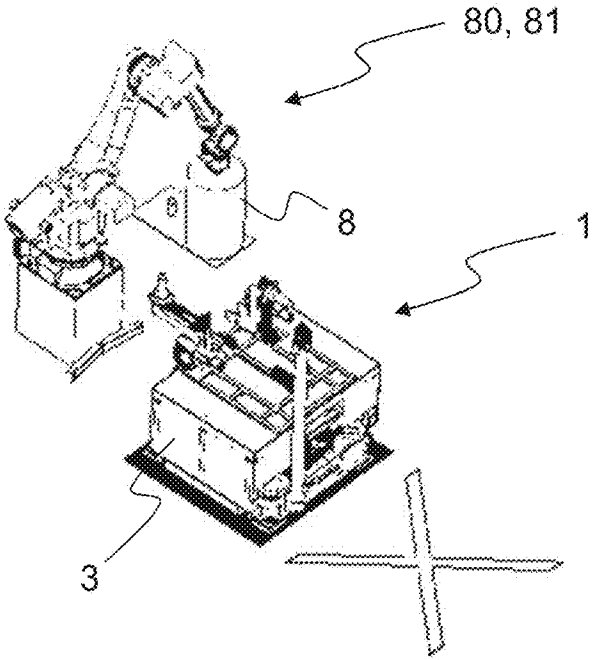

A further step is illustrated by the FIGS. 10B and 10C seen in conjunction. The holding mandrel 6 of the transport apparatus 1 is swiveled from the driving position FP of FIG. 10B into the working position AP of FIG. 10C. A longitudinal axis of the holding mandrel 6 is then perpendicularly oriented in the working position AP. It is alternatively conceivable that a working position AP is characterized by the holding mandrel 6 being situated in a horizontal or in an inclined orientation. In the exemplary embodiment of FIG. 10C, the holding mandrel 6 is moreover situated outside a lateral circumference of the driverless transport vehicle 2 designed as part of the transport apparatus 1.

In the working position AP of the holding mandrel 6, the handling device 80 can position a supply roll 8 on the holding mandrel 6. For this purpose, the handling device 80 dips its clamping mandrel 84 into a hollow cylindrical core 9 (cf. FIG. 11F) of the supply roll 8 according to FIG. 10D and subsequently enlarges the cross-sectional diameter of the clamping mandrel 84, whereby the supply roll 8 is fixed according to FIG. 10D in a clamping manner to the clamping mandrel 84 of the handling device 80.

Figure 10F:
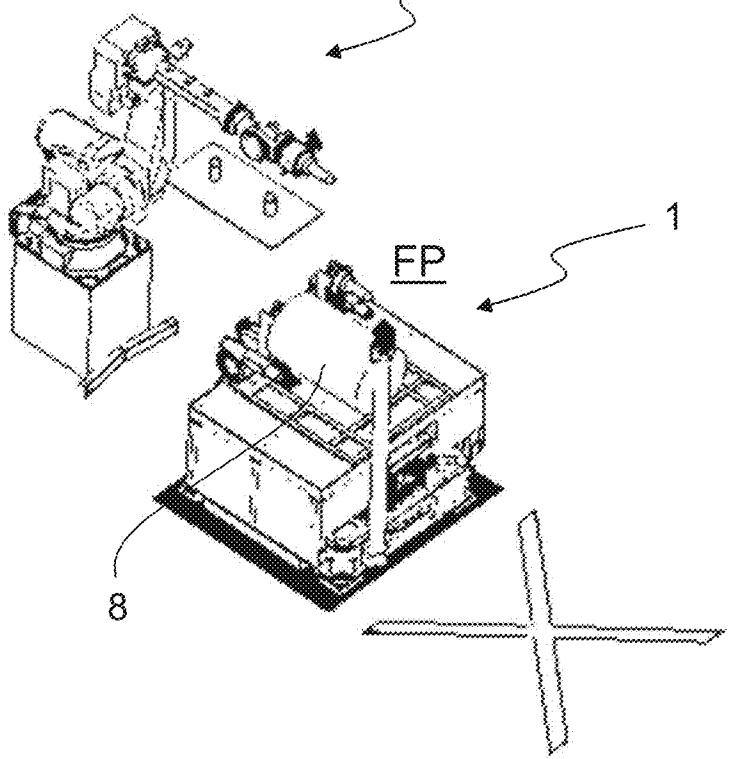
Figure 10E:
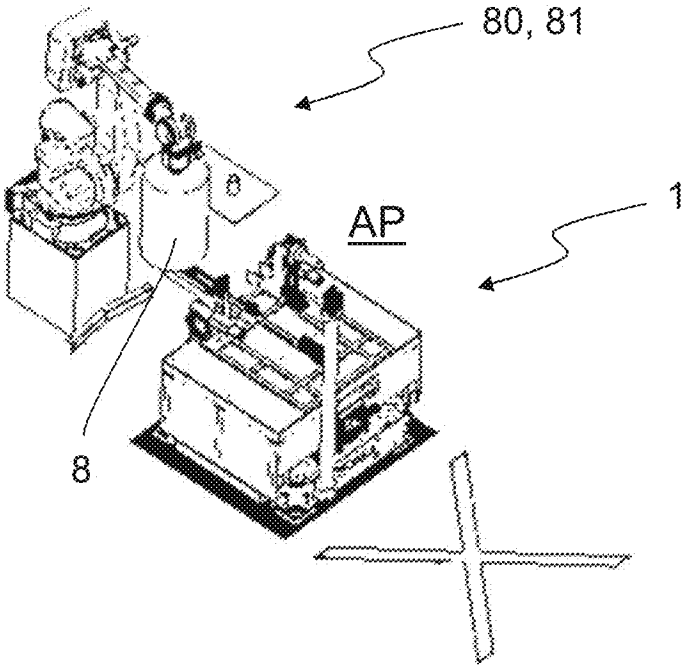

In FIG. 10E, the handling device 80 has positioned the supply roll 8 on the holding mandrel 6 of the transport apparatus 1, whereupon the clamping mandrel 84 of the handling device 80 is extracted according to FIG. 10F from the hollow cylindrical core of the supply roll 8.

After the clamping mandrel 84 has left the hollow cylindrical core 9 of the supply roll 8, the transport apparatus 1 can swivel the holding mandrel 6 together with the supply roll 8 from the working position AP of FIG. 10E into the driving position FP of FIG. 10F and transport the supply roll 8 toward a packaging apparatus 20, while maintaining the driving position FP for the holding mandrel 6 and for the supply roll 8 being carried via the holding mandrel 6.

The schematic perspective views of FIGS. 11A to 11F show a depleted supply roll being removed from an embodiment of a packaging apparatus 20 via an embodiment of a transport apparatus 1 according to the invention.

As already mentioned above, the transport apparatus 1 can move into a vicinity of the packaging apparatus 20 with the help of the navigation aids 38.

Figure 11A:
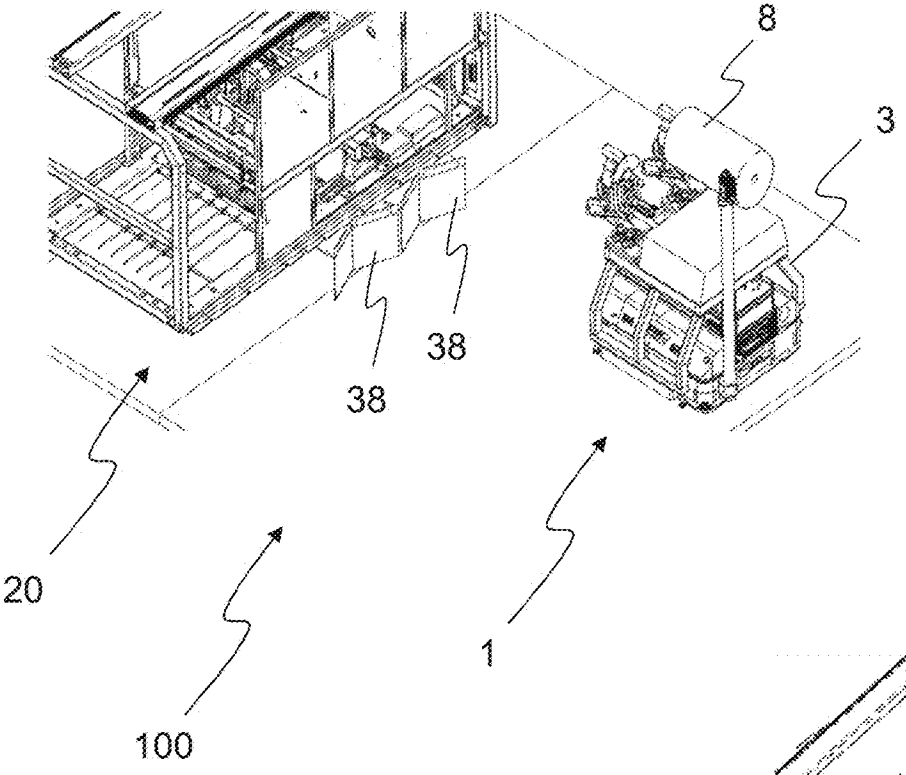
FIGS. 11A to 11F show a depleted supply roll being removed from an embodiment of a packaging apparatus via an embodiment of a transport apparatus according to the invention.
Figure 11B:
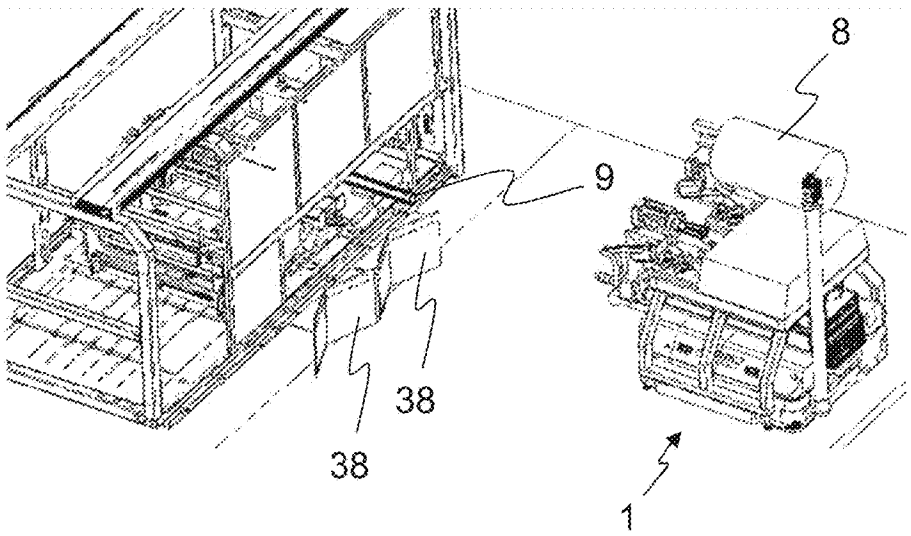

It is discernible from FIG. 11B that the packaging apparatus 20 can move a hollow cylindrical core 9 of a depleted supply roll out of the packaging apparatus 20 by a machine mandrel 60 (cf. FIG. 6) that is adjustable in axial direction.

Figure 11C:
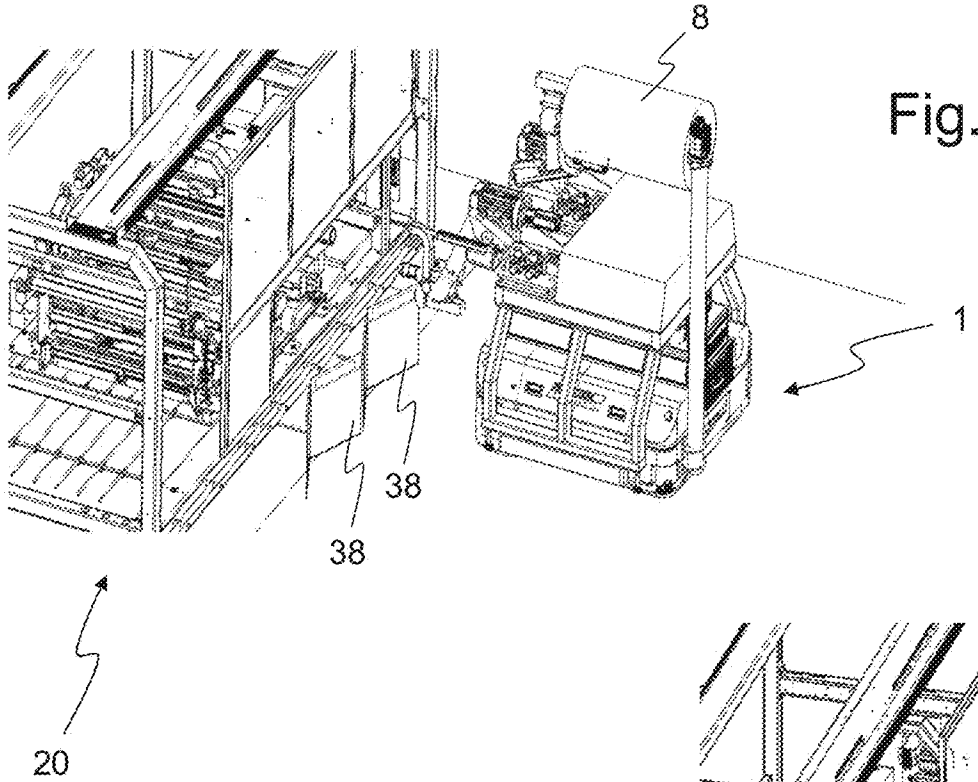
Figure 11D:
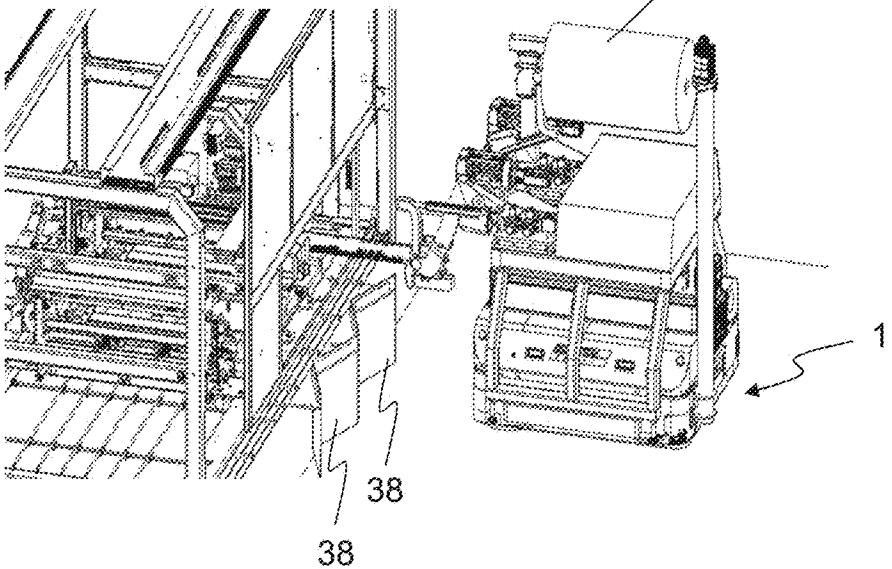

The FIGS. 11C and 11D seen in conjunction illustrate the hollow cylindrical core 9 then being slid onto a holding mandrel 6 of the transport apparatus 1, whereupon the transport apparatus 1 fixes the hollow cylindrical core 9 to the holding mandrel 6 in a clamping manner.

Figure 11E:
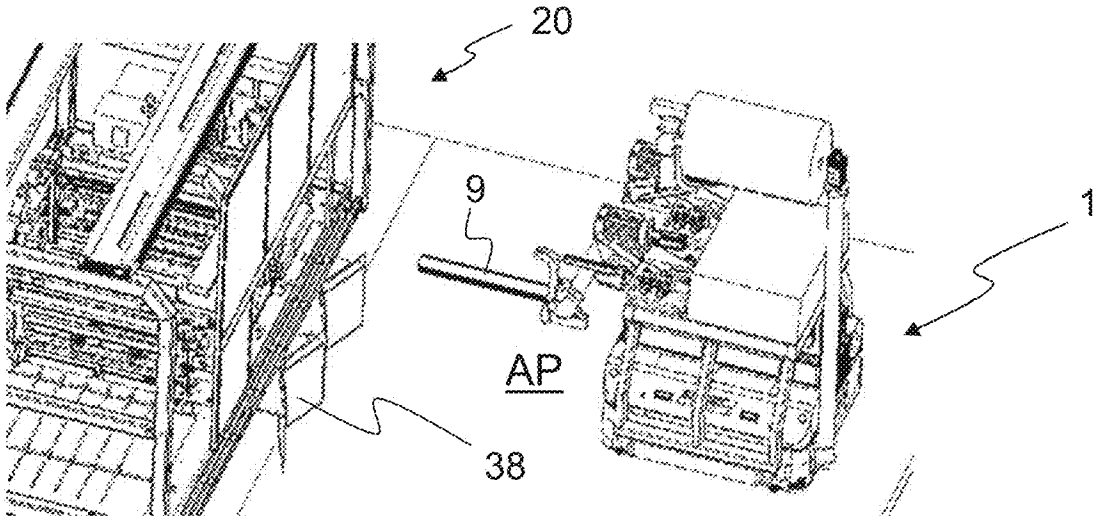

The transport apparatus 1 hereupon moves away from the packaging apparatus 20 according to FIG. 11E and extracts the hollow cylindrical core 9 from the machine mandrel 60 of the packaging apparatus 20. It can be alternatively provided that the transport apparatus 1 first remains in its position with the machine mandrel 60 being moved back in axial direction into the packaging apparatus 20 and with the hollow cylindrical core 9 being hereby extracted from the machine mandrel 60.

Figure 11F:
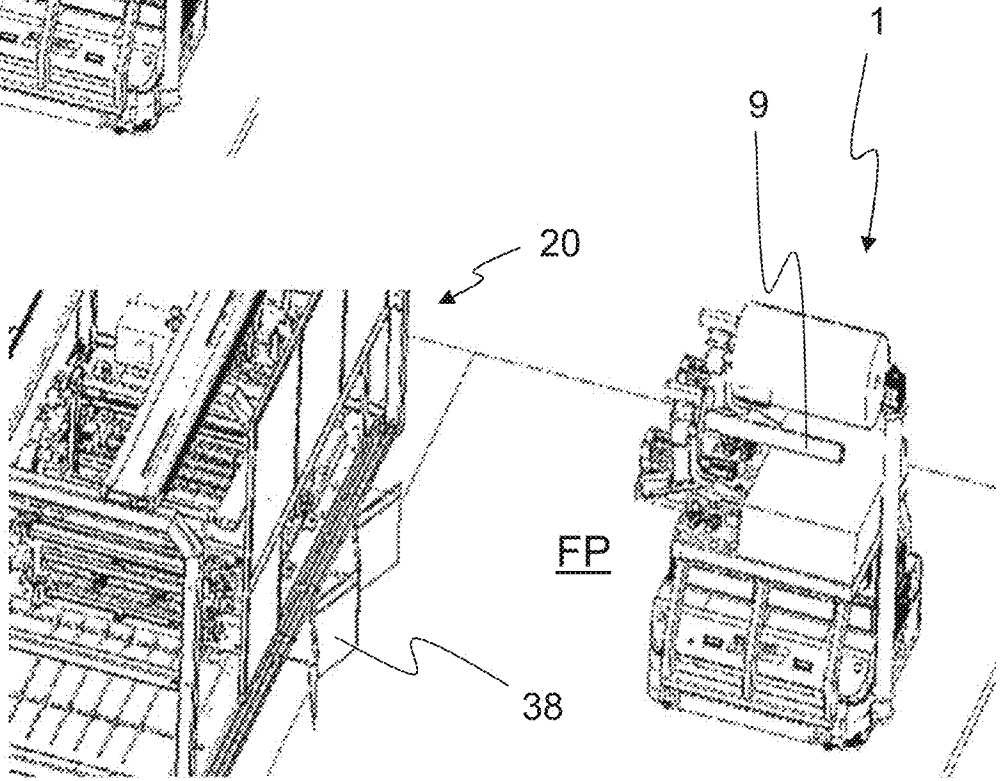

The FIGS. 11E and 11F seen in conjunction illustrate the holding mandrel 6 carrying the hollow cylindrical core 9 then being swiveled from the above-described working position AP into the driving position FP. The transport apparatus 1 then moves toward a handling device 80 (cf. FIG. 9), while the holding mandrel 6 carrying the hollow cylindrical core 9 continues to be in the driving position FP. The handling device 80 then receives the hollow cylindrical core 9 from the transport apparatus 1 and deposits it at a specified location or throws it into a container for waste disposal, if applicable.

The schematic perspective views of FIGS. 12A to 12D show a new supply roll 8 being introduced into an embodiment of a packaging apparatus 20 by an embodiment of a transport apparatus 1 according to the invention.

Figure 12A:
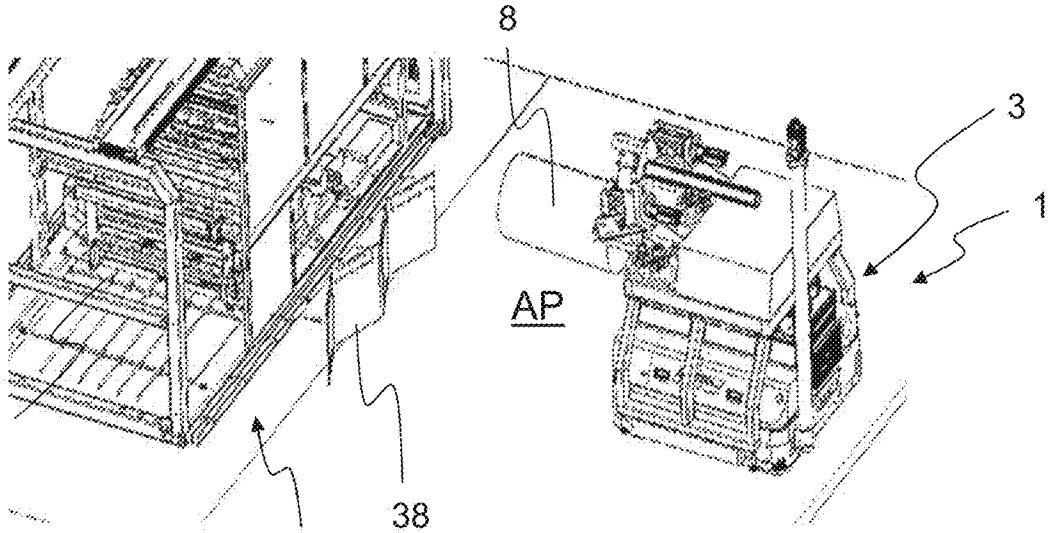
FIGS. 12A to 12E show a new supply roll being introduced into an embodiment of a packaging apparatus by an embodiment of a transport apparatus according to the invention.

In the illustration of FIG. 12A, the transport apparatus 1 moves toward the packaging apparatus 20 together with a supply roll 8, which is being held in the transport apparatus 1 via the adapter 3. The holding mandrel 6 of the adapter 3 in FIG. 12A is situated in the above-described working position AP, with the holding mandrel 6 fixing the supply roll 8.

Figure 12B:
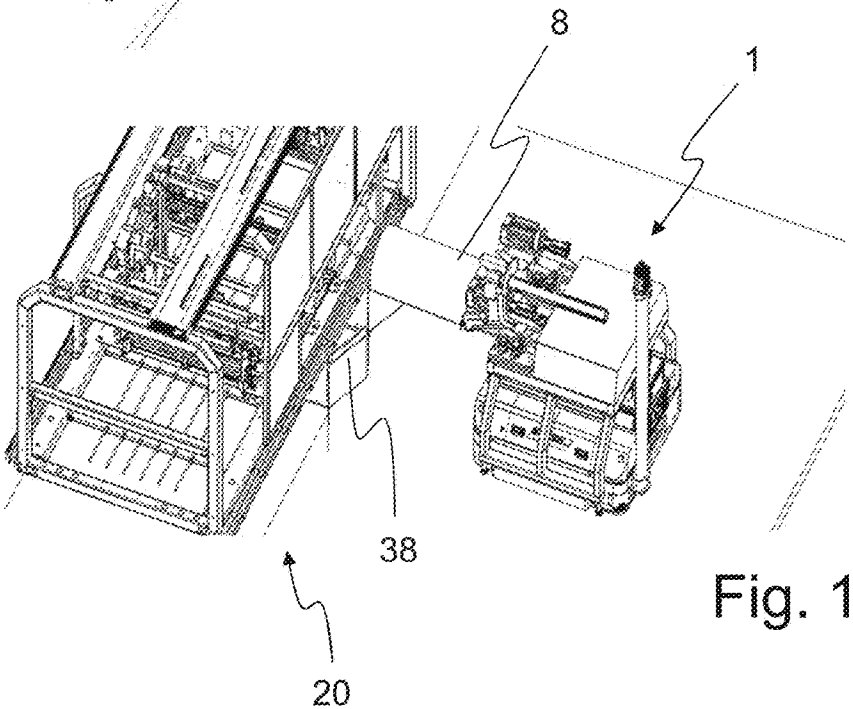

In FIG. 12B, the transport apparatus 1 has further advanced toward the packaging apparatus 20 using the navigation aids 38 for the purpose of referencing, with the positions of the navigation aids 38 having been sensor-detected by the transport apparatus 1.

Figure 12D:
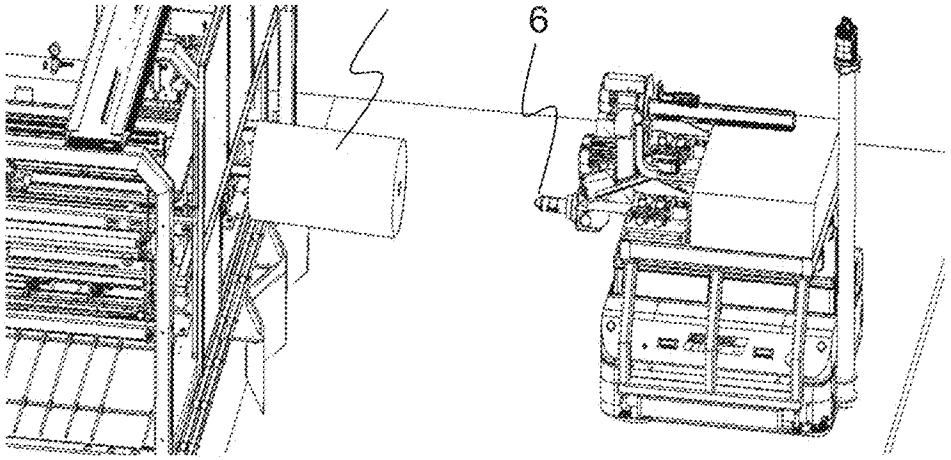
Figure 12C:
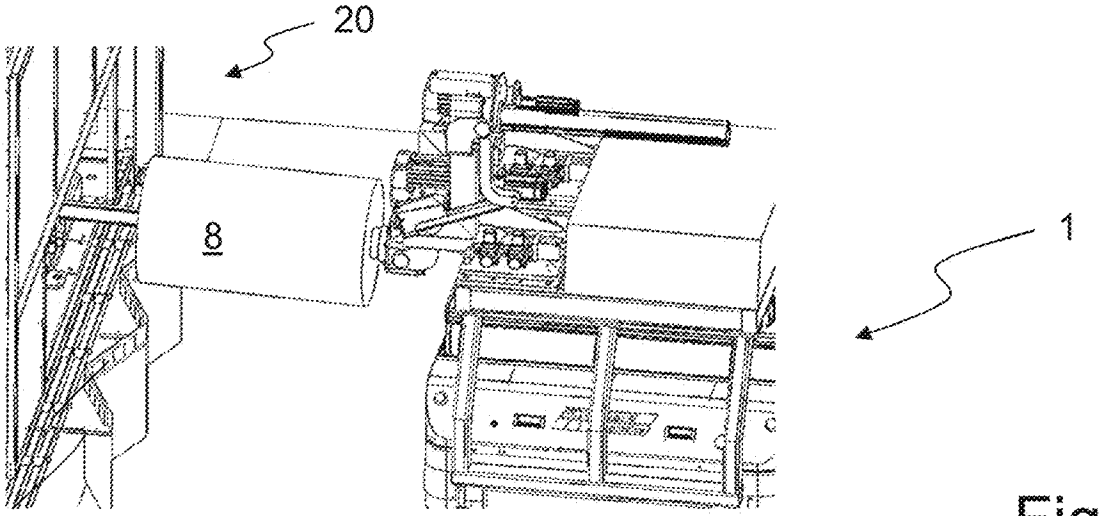

The FIG. 12C shows the transport apparatus 1 then sliding the supply roll 8 onto the machine mandrel 60 of the packaging apparatus packaging apparatus 20 and then moving away from the packaging apparatus 20 according to FIG. 12D.

It is alternatively possible for the transport apparatus 1 to remain in its position, with the machine mandrel 60 being moved in axial direction and hereby receiving the supply roll 8. The further sliding of the supply roll 8 onto the machine mandrel 60 is then carried out according to FIG. 12E by the insertion plate 62.

Figure 12E:
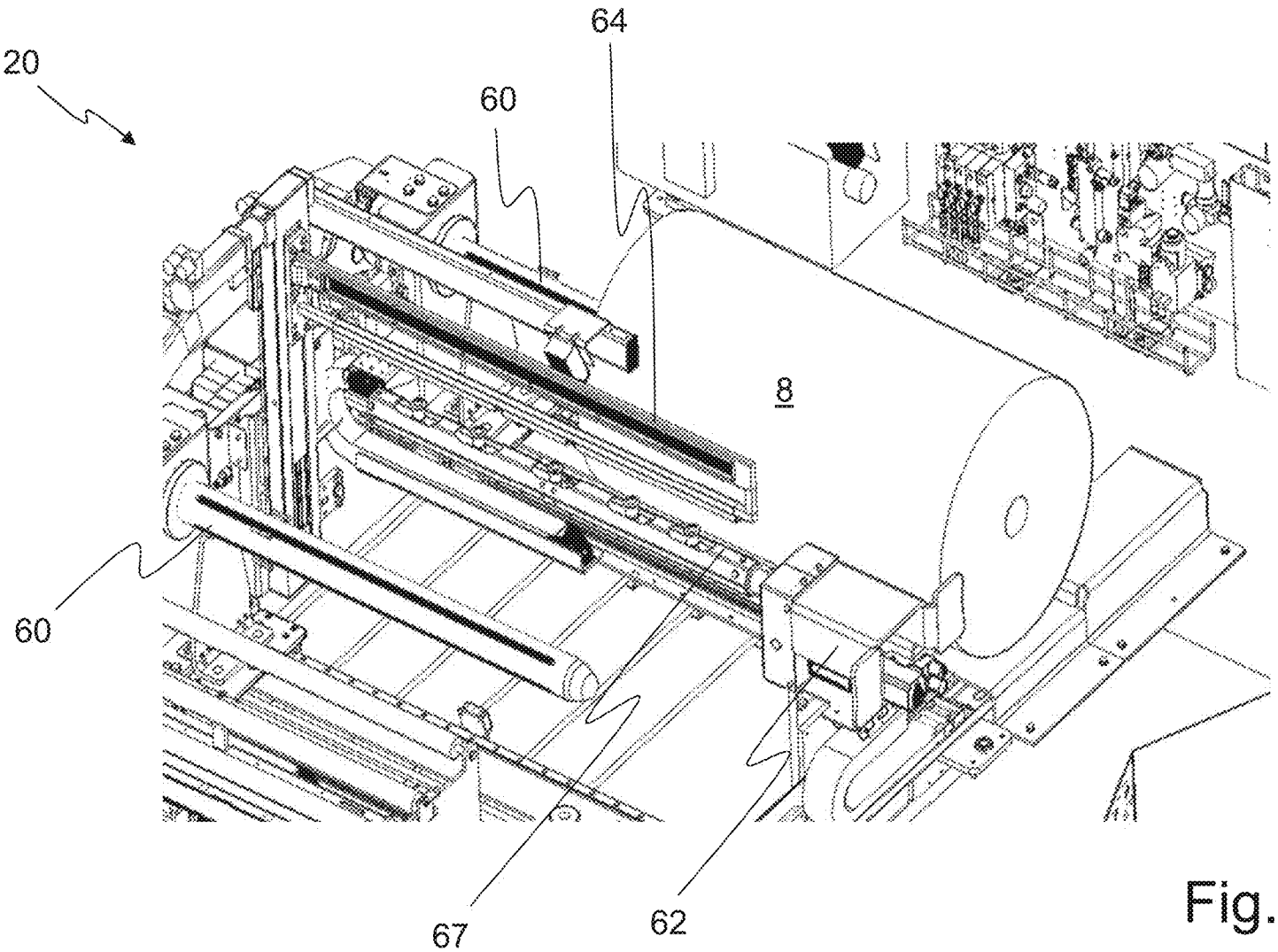

The further components illustrated in FIG. 12E are designed according to the illustration of FIG. 6, so that the according description is referred back to.

The schematic perspective views of FIGS. 13A to 13F show a delivery of a hollow cylindrical roll core 9 of a used-up supply roll from an embodiment of a transport apparatus 1 according to the invention to a handling device 80.

Figure 13A:
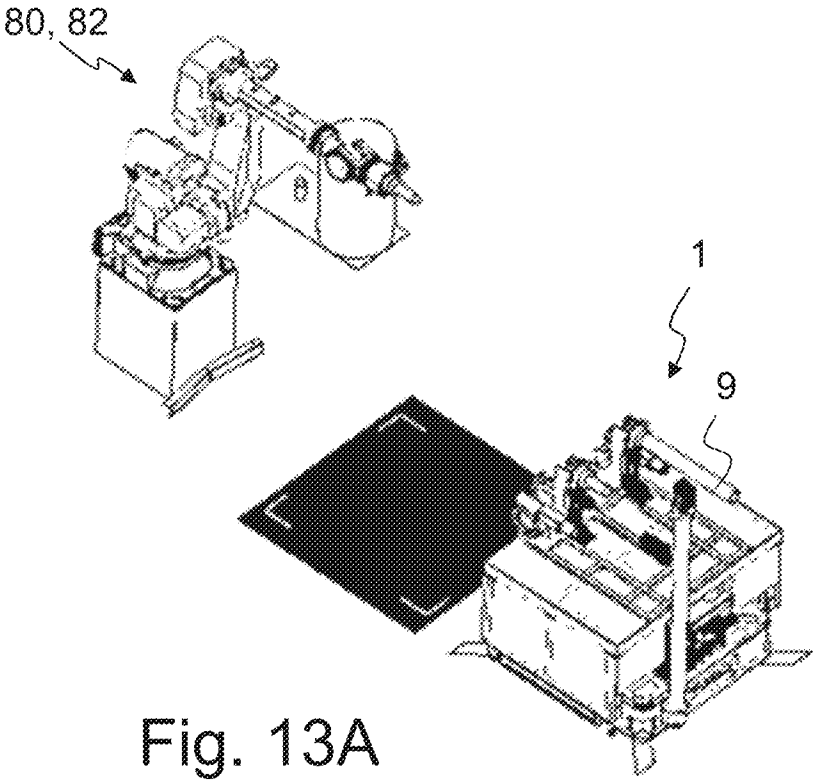
FIGS. 13A to 13F show a delivery of a hollow cylindrical roll core of a used-up supply roll from an embodiment of a transport apparatus according to the invention to a handling device.
Figure 13B:
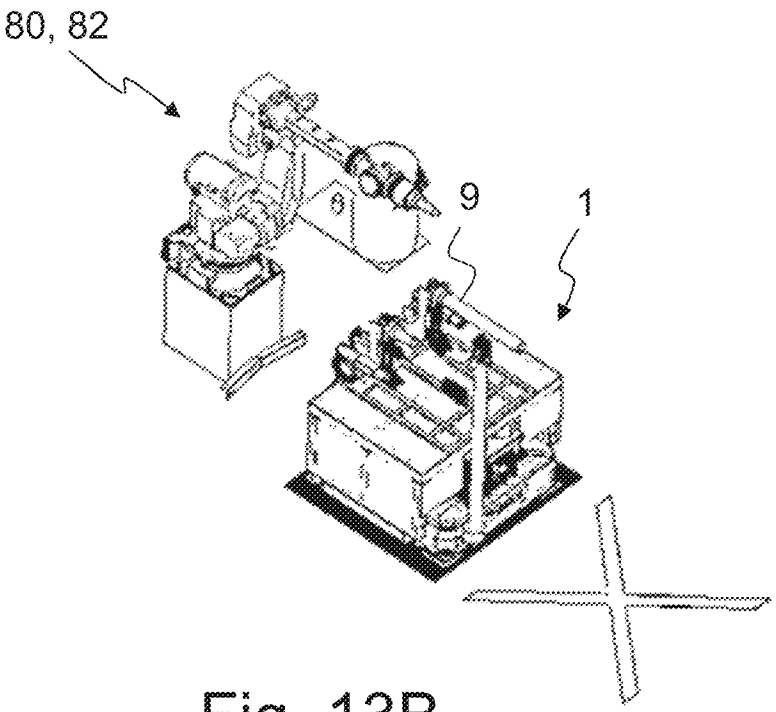

The transport apparatus 1 first moves from the position of FIG. 13A into the position of FIG. 13B, in which context the navigation or the movement can continue to be carried out with the help of a sensor system 55.

Figures 13C, 13D:
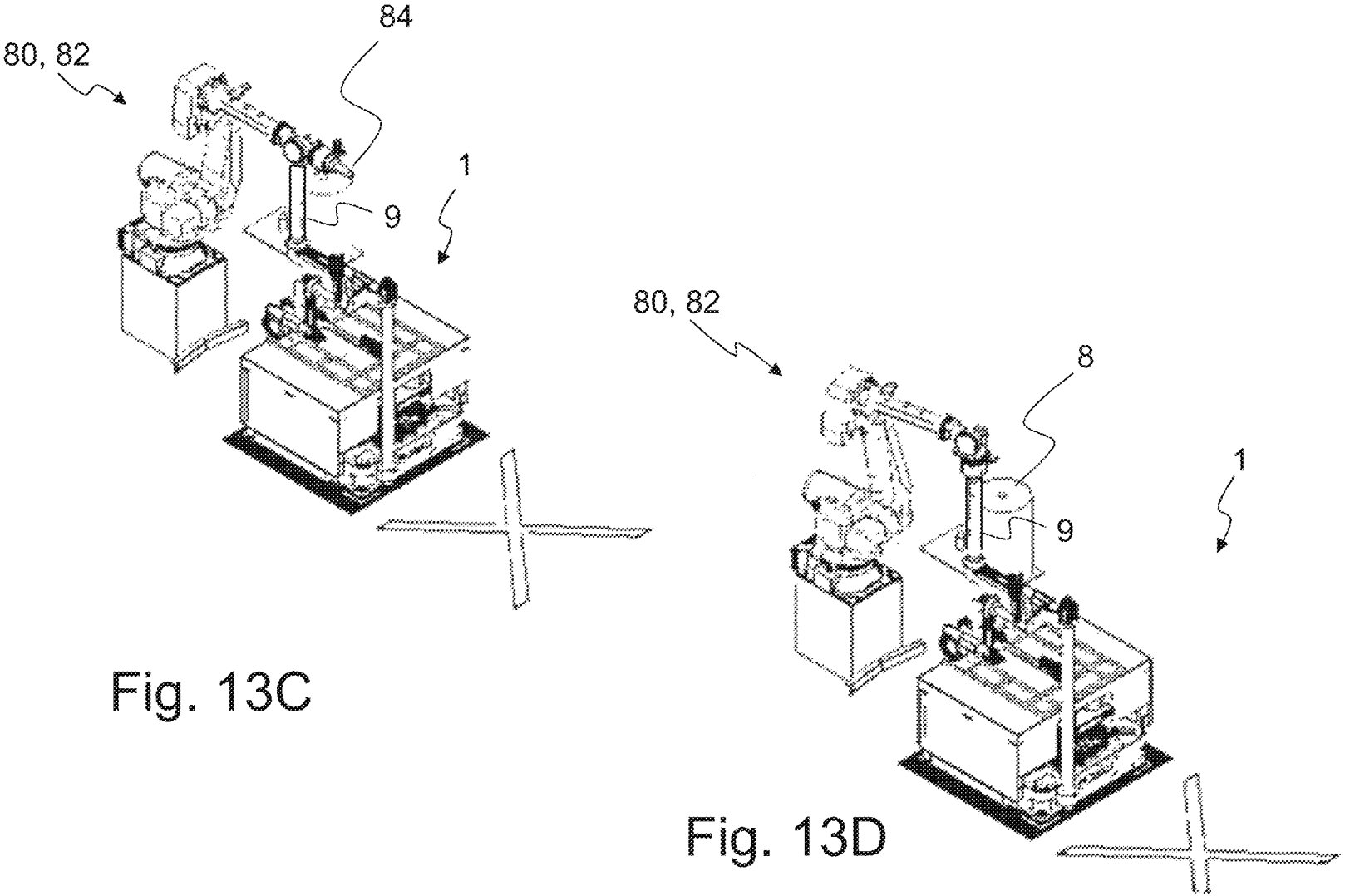

FIGS. 13B and 13C seen in conjunction illustrate the holding mandrel 6 on which the hollow cylindrical core 9 is arranged then being swiveled, with the result that the holding mandrel 6 and the thereon arranged hollow cylindrical core 9 are perpendicularly oriented. In further embodiments, it is possible for the holding mandrel 6 on which the hollow cylindrical core 9 is arranged to be swiveled with the result that the holding mandrel 6 is hereupon situated in a horizontal orientation.

Figure 13F:
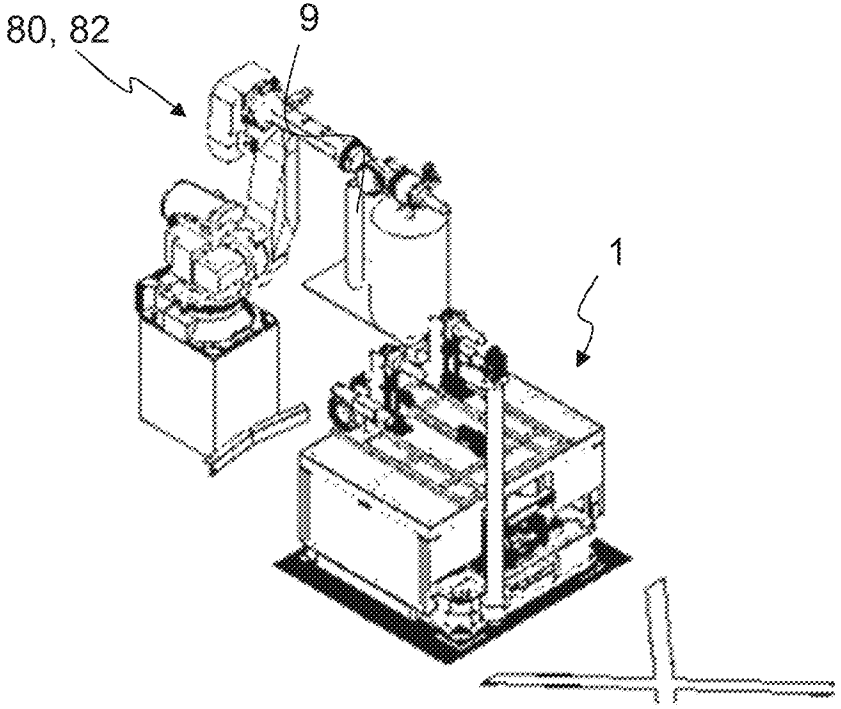
Figure 13E:
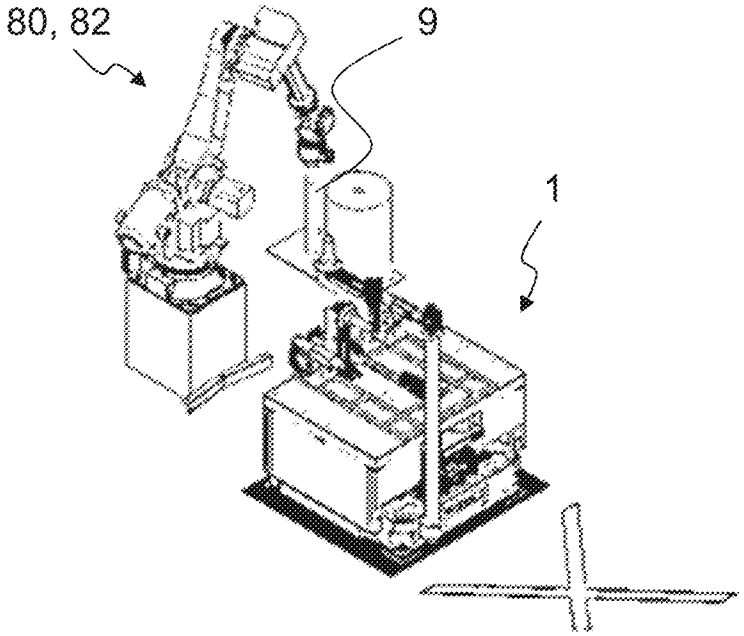

The handling device 80 subsequently dips its clamping mandrel 84 into the hollow cylindrical core 9 and fixes it in a clamping manner to the clamping mandrel 84 as shown in FIG. 13D. The hollow cylindrical core 9 is subsequently deposited at a specified location via the handling device 80, whereupon the handling device 80 according to FIG. 13F is ready to receive a further hollow cylindrical core 9.

It is conceivable for alternative embodiments that the transport apparatus 1 deposits a used-up supply roll 1 at a defined location with the holding mandrel 6 being swiveled into a certain position and subsequently being released. Depending on a tilt of the holding mandrel 6, the hollow cylindrical core 9 can be slid off the holding mandrel 6 by gravity or with the help of the pressure plate 23 already described with FIG. 2. After deposit, it is possible to navigate to the position illustrated in FIG. 13F in order to receive a further hollow cylindrical core 9. With such an alternative, it is possible to reduce the capacity utilization of the handling device 80, as required.

The schematic perspective views of FIGS. 14A to 14D show an embodiment of an adapter 3 being deposited via an embodiment of a driverless transport vehicle 2. The driverless transport vehicle 2 and the adapter 3 together form an embodiment of a transport apparatus 1 according to the invention.

Figure 14A:
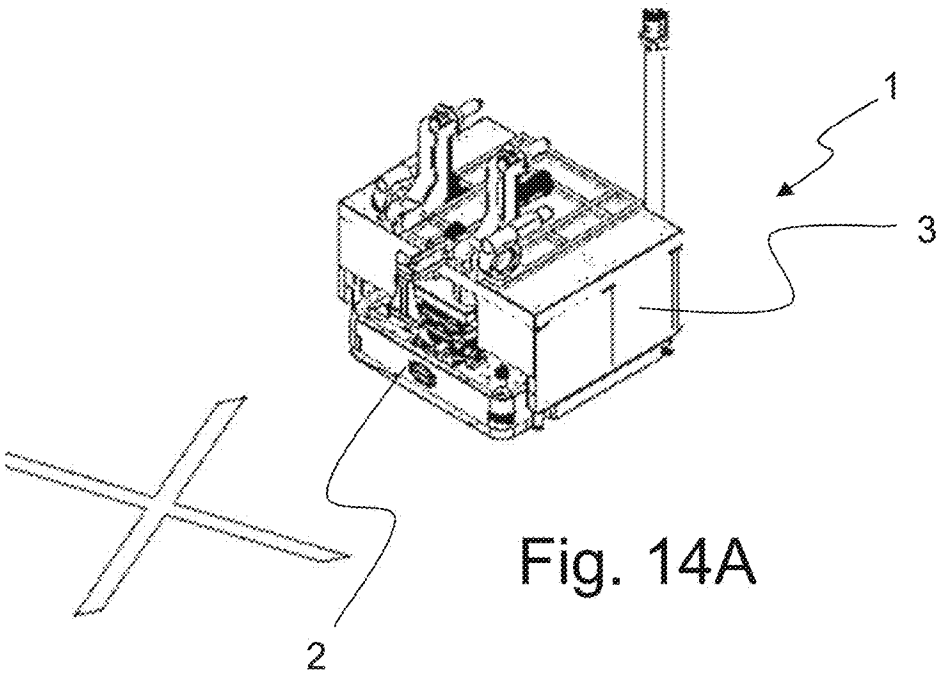
FIGS. 14A to 14D show an embodiment of an adapter being deposited via an embodiment of a driverless transport vehicle.
Figure 14B:
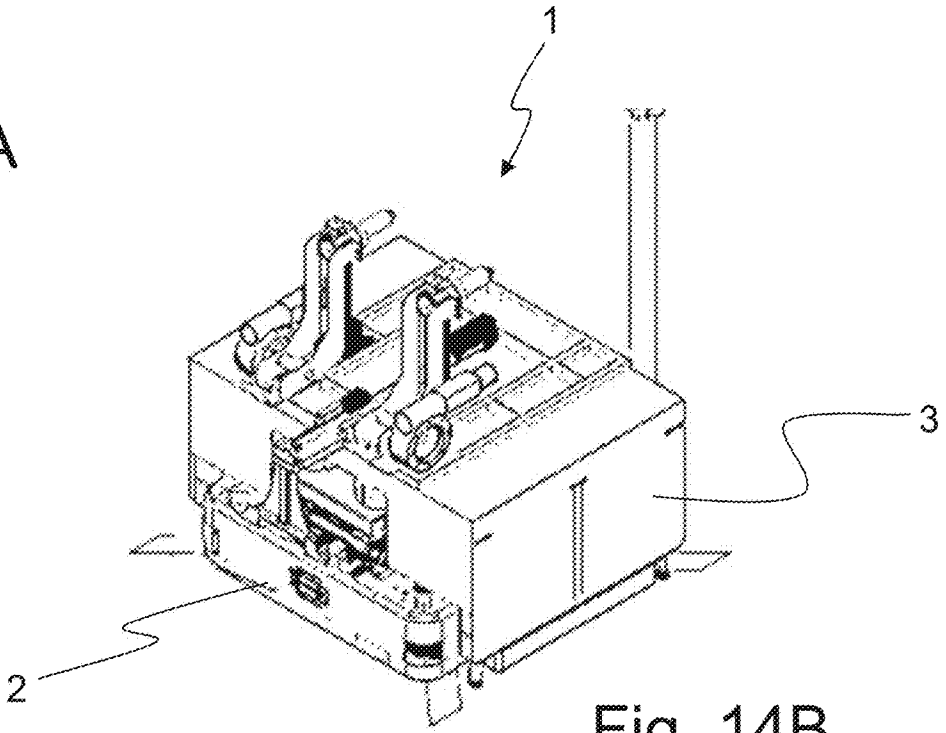

The transport apparatus 1 is moved from the position of FIG. 14A into the position of FIG. 14B, which is provided for depositing the adapter 3. The transport apparatus 1 can then undo a fixed connection between the driverless transport vehicle 2 and the adapter 3. It is conceivable, for example, that a connection (cf. FIGS. 4A and 4B) produced by a clamp bolt 34 (cf. FIG. 3) and a clamping mechanism 58 is undone.

Figure 14C:
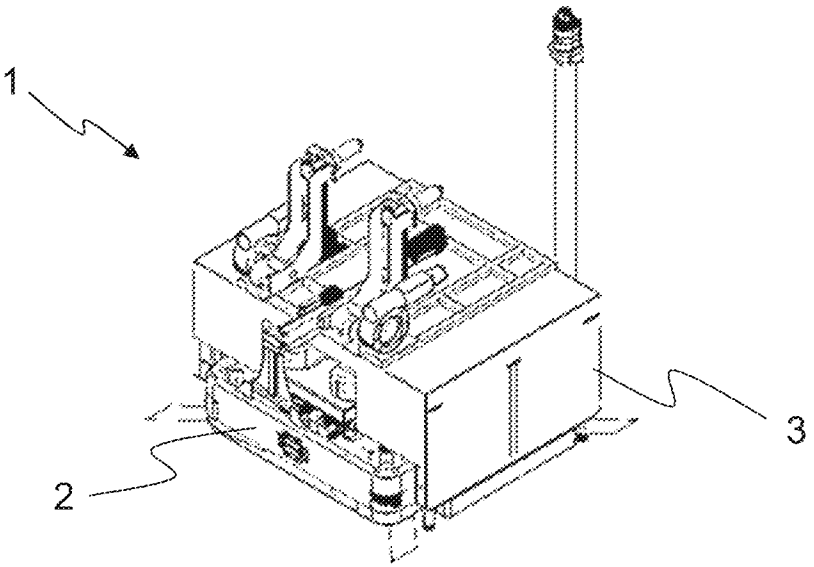
Figure 14D:
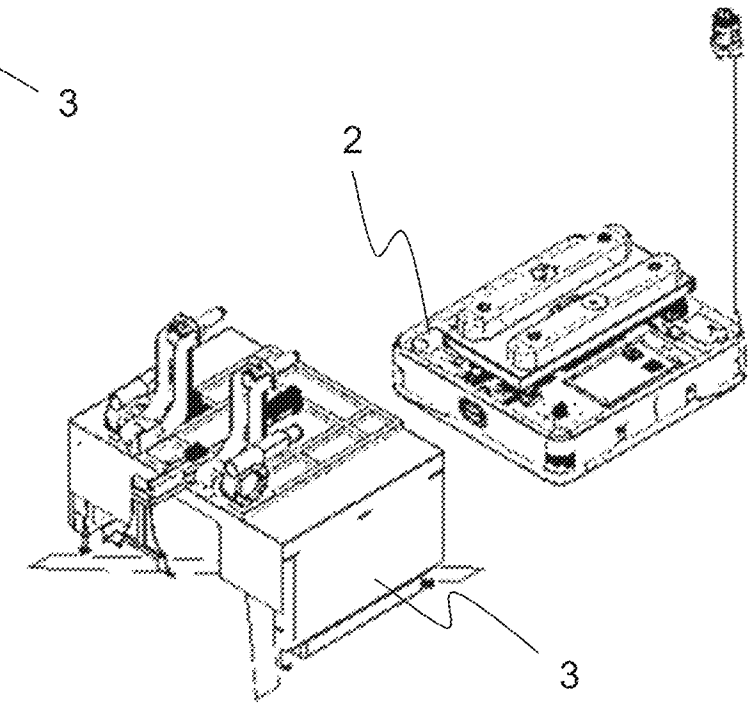

In FIG. 14C, the adapter 3 is positioned via the driverless transport vehicle 2 on a floor surface, for which purpose a lifting unit 50 or a lifting mechanism 51 (cf. FIGS. 4A and 4B) is lowered. The driverless transport vehicle 2 can subsequently move away according to FIG. 14D from the deposited adapter 3.

Figure 15:
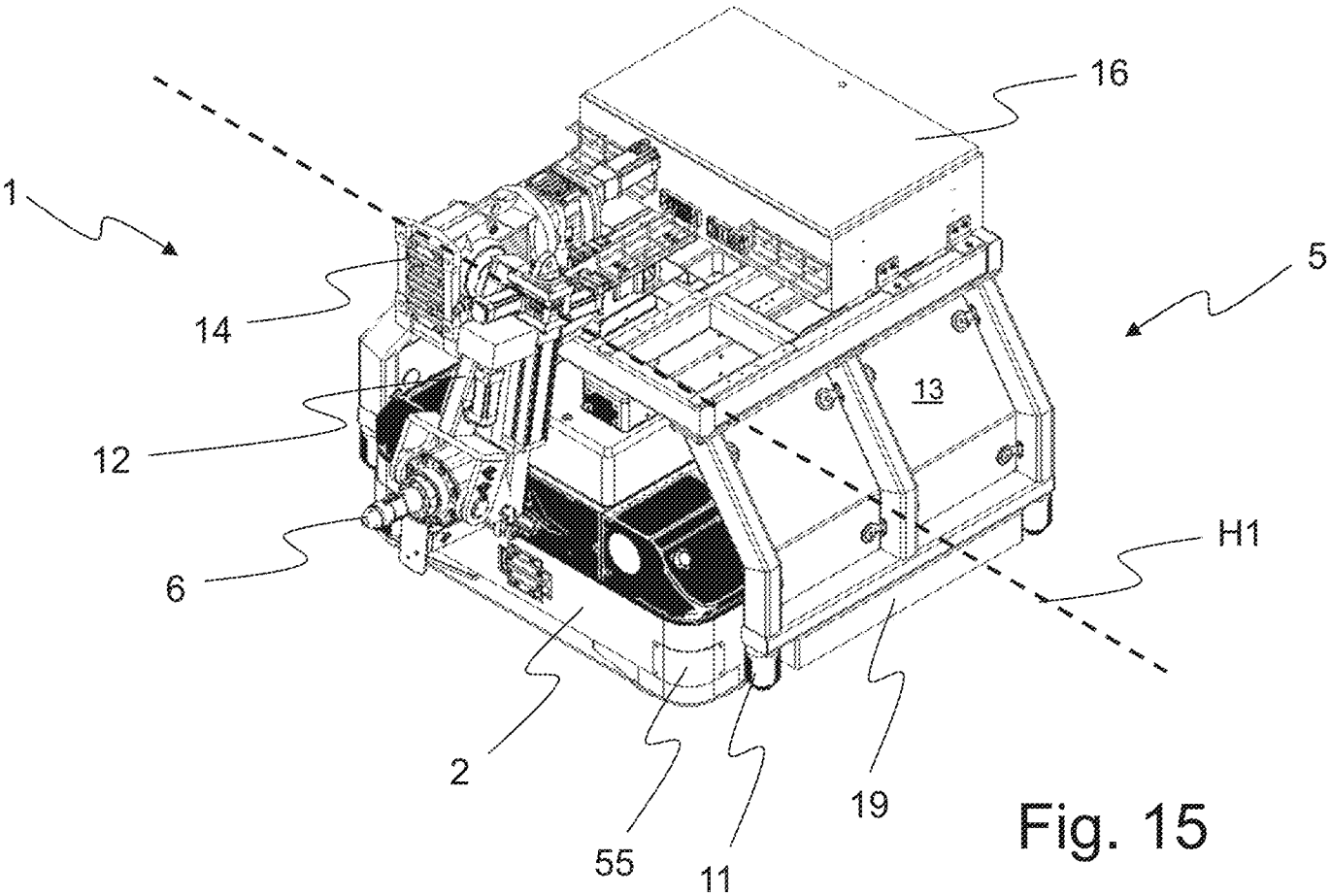
FIGS. 15, 16A, 16B, 17A to 17C, 18A, 18B, 19 and 20 show further embodiments of transport apparatuses according to the invention.

The schematic perspective view in FIG. 15 shows a further embodiment of a transport apparatus 1 according to the invention. The transport apparatus 1 of the embodiment of FIG. 15 furthermore has a driverless transport vehicle 2 as well as an adapter 3 connected to the driverless transport vehicle 2. The components in FIG. 15 provided with reference numbers correspond to the embodiment of FIGS. 1 to 3, so that the previous description is referred back to.

The embodiment of the transport apparatus 1 in FIG. 15 differs from the embodiment of FIGS. 1 to 3 in that the adapter 3 has exactly one holding mandrel 6 and exactly one actuator 14, via which exactly one actuator 14 the exactly one holding mandrel 6 can be swiveled together with the support arm 12 to which the exactly one holding mandrel 6 is attached.

It is possible in embodiments according to FIG. 15 for the transport apparatus 15 to be moved several times back and forth between a packaging apparatus 20 and a handling device 80 in order to remove a hollow cylindrical core 9 from the packaging apparatus 20 by the exactly one holding mandrel 6 and to subsequently introduce a supply roll 8 into the packaging apparatus 20 by the exactly one holding mandrel 6. Compared to the embodiment of FIGS. 1 to 3, the embodiment of FIG. 15 has a simple structure and is moreover inexpensive to produce.

Figure 16B:
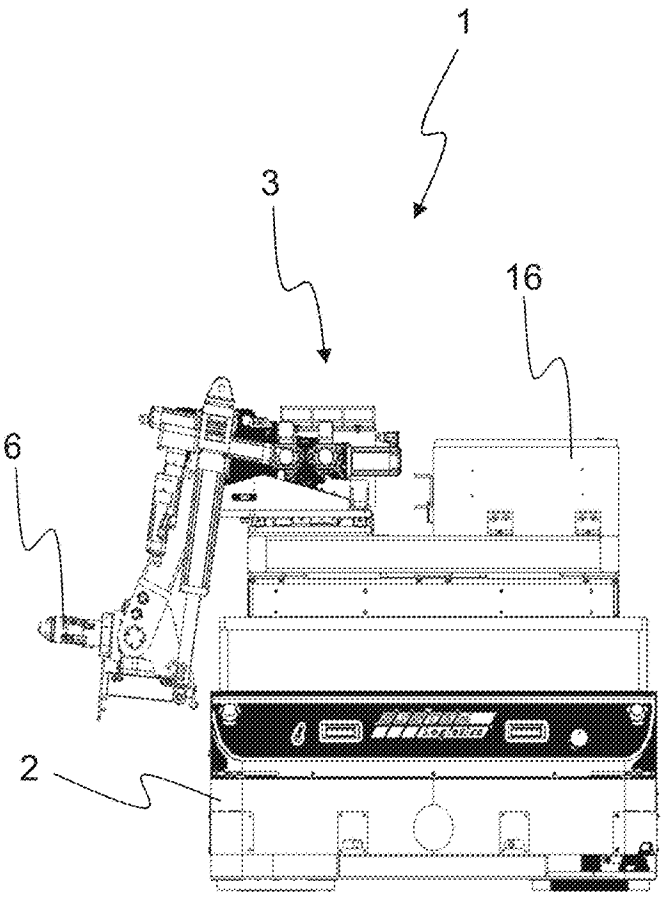
Figure 16A:
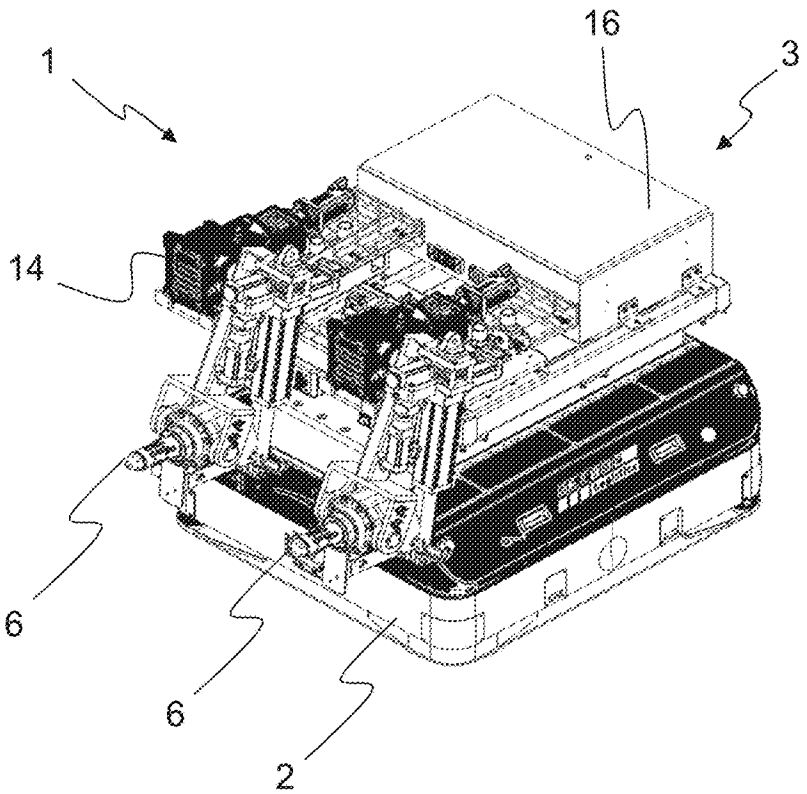

The schematic illustrations in FIGS. 16A and 16B show a further embodiment of a transport apparatus 1 according to the invention. The exemplary embodiment in FIGS. 16A and 16B differs from the embodiment of FIGS. 1 to 3 with regard to the construction of the adapter, which continues to be illustrated with the reference number 3.

The support feet 11 present in the exemplary embodiment of the FIGS. 1 to 3 are not provided in the exemplary embodiment of the FIGS. 16A and 16B. In order to arrange the adapter 3 on the driverless transport vehicle 2, a handling device can be provided, if required, which positions the adapter 3 coming from above on the driverless transport vehicle 2 or which slides the adapter 3 coming from the front onto the driverless transport vehicle 2. If the adapter 3 is not required, it can be deposited via the handling device on a rack.

Figure 17B:
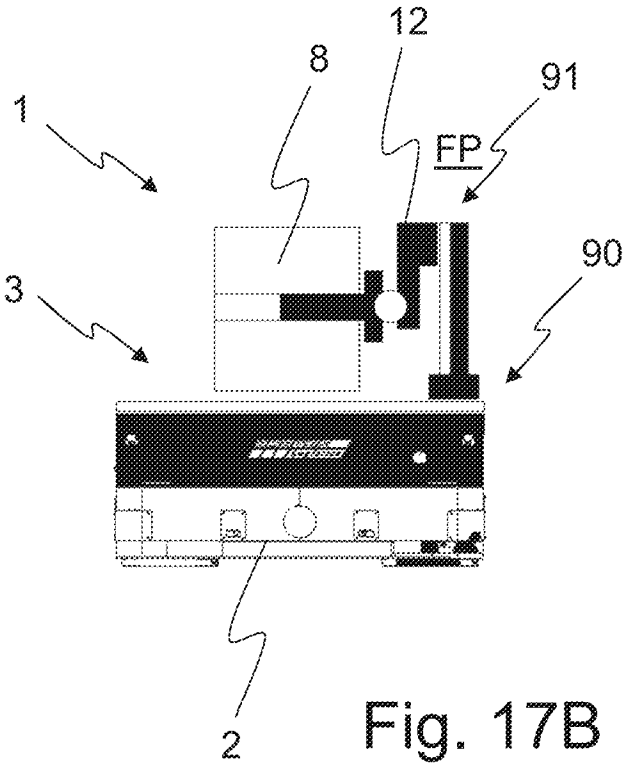
Figure 17A:
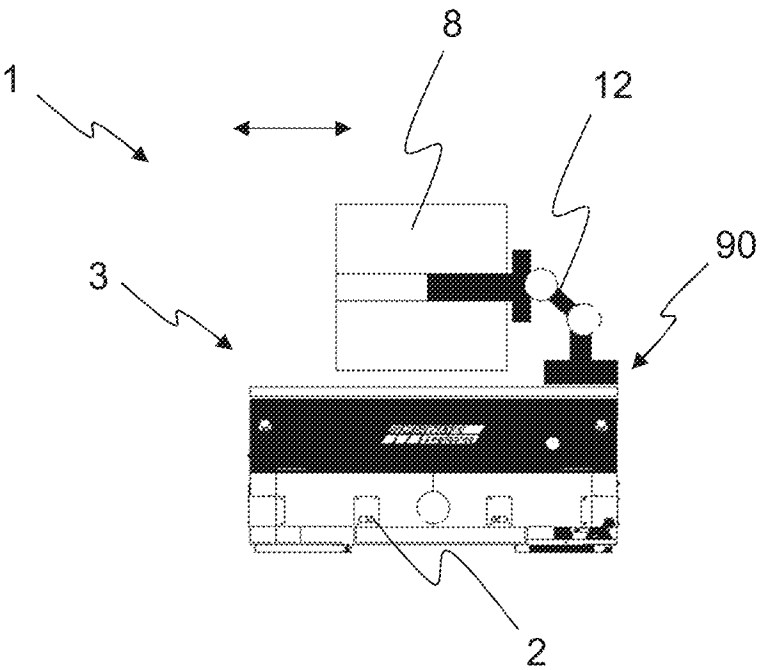

The schematic side view of FIG. 17A shows a further embodiment of a transport apparatus 1 according to the invention. The adapter 3 in the embodiment of FIG. 17A also has a holding mandrel 6 with a supply roll 8 already arranged thereon. The holding mandrel 6 is arranged on a support arm 12, which has a plurality of joints and can thus be swiveled. The number 90 refers to a linear actuator.

As indicated by an arrow illustration in FIG. 17, the support arm 12 can be moved back and forth on the driverless transport vehicle 2 together with the holding mandrel 6 and the supply roll 8 held in a clamping manner via the holding mandrel 6 in order to deliver a supply roll 8 to a packaging apparatus 20 and in order to take a position behind the lateral circumference of the driverless transport vehicle 2 during a driving movement of the transport apparatus 1.

Like the exemplary embodiment of a transport apparatus 1 according to FIG. 17A, the exemplary embodiment of FIG. 17B also has a linear actuator 90. Additionally provided is a further linear actuator 91, which can lift and lower the support arm 12, the holding mandrel 6, and the supply roll 8 received via the holding mandrel 6 in vertical direction.

Figure 17C:
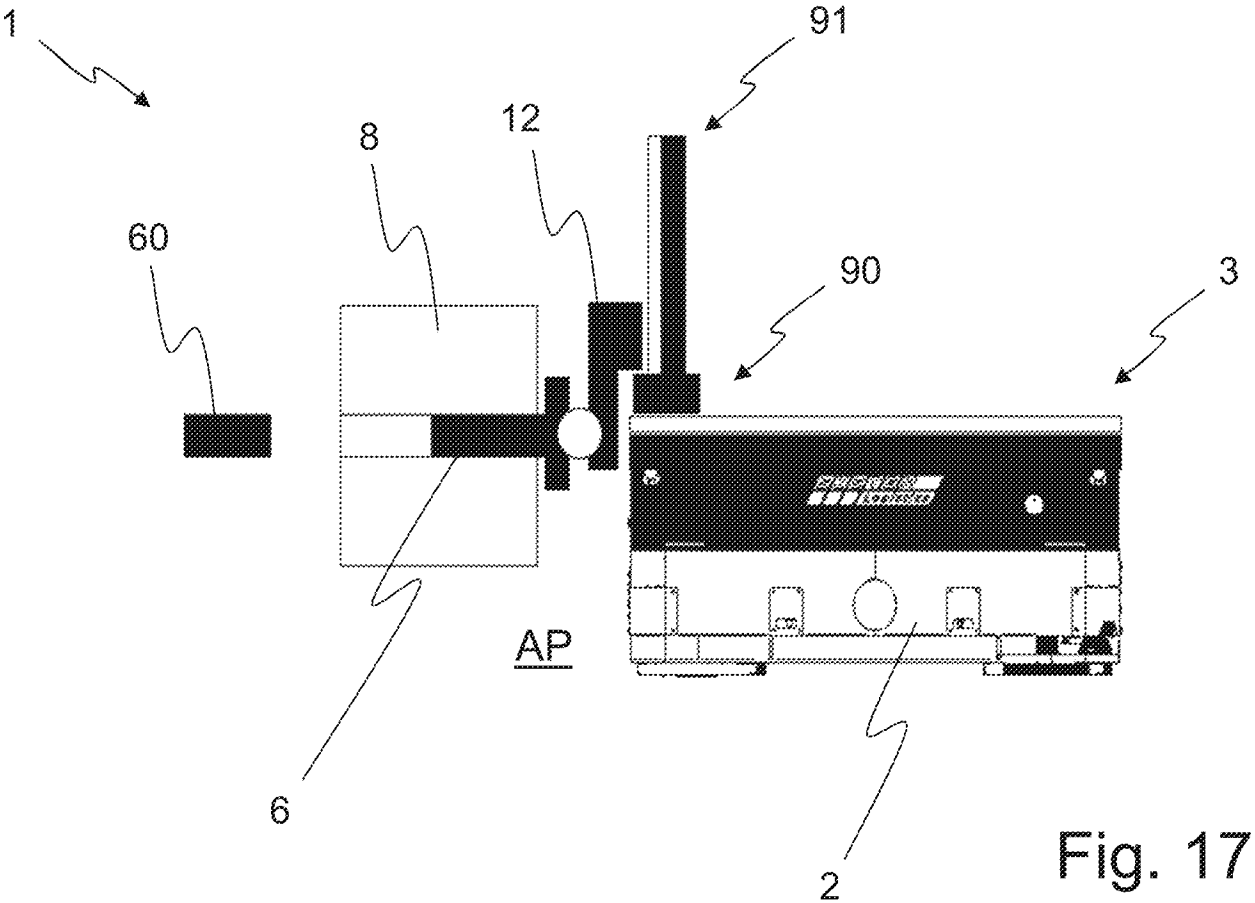

In this context, the FIGS. 17B and 17C seen in conjunction illustrate a change of the holding mandrel 6 from a driving position FP into a working position AP, in which working position AP the holding mandrel 6 is situated at the same height as the machine mandrel 60 of a packaging apparatus 20 and can thus deliver the supply roll 8 to the machine mandrel 60 of the packaging apparatus 20. The movement from the driving position FP into the working position AP is carried out with the help of the linear actuators 90 and 91.

It is also conceivable for various embodiments to be provided only with the further linear actuator 91, while the linear actuator 90, which causes the horizontal movement of the holding mandrel 6, can be absent in these embodiments. The further linear actuator 91 can then be arranged in the area of a front side of the adapter 3 or in a position according to FIG. 17C.

Figure 18B:
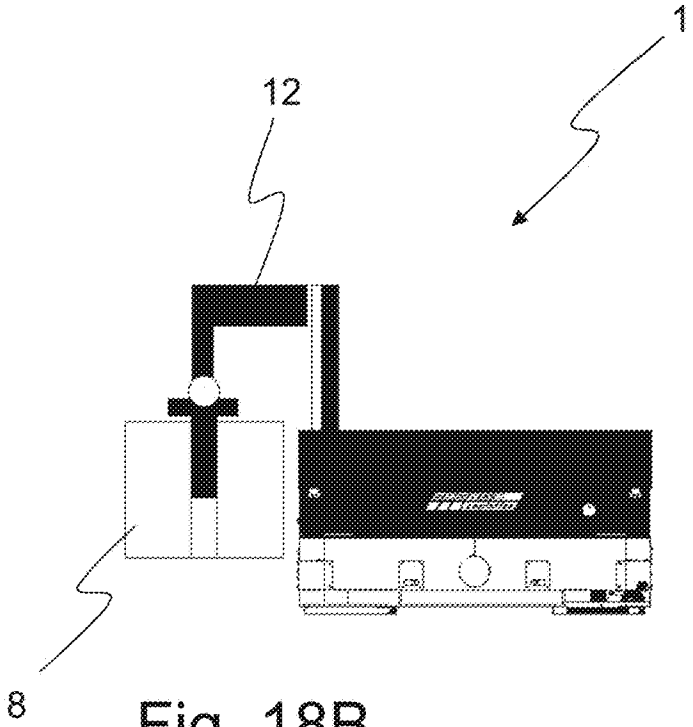
Figure 18A:
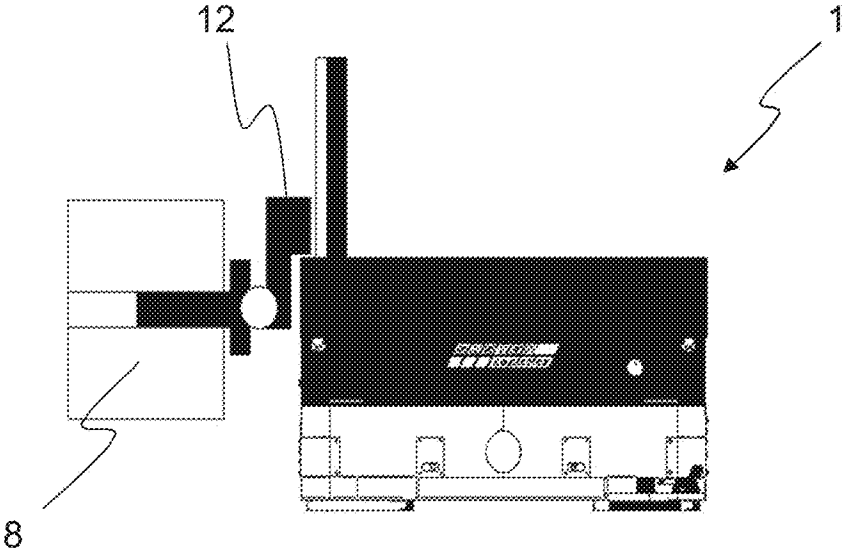

The schematic side views of FIGS. 18A and 18B show a further embodiment of a transport apparatus 1 according to the invention. The further linear actuator 91, which can lift and lower the support arm 12 and the holding mandrel 6 in vertical direction, is also provided in the embodiment of the FIGS. 18A and 18B.

FIGS. 18A and 18B seen in conjunction also illustrate that the holding mandrel 6 can be arranged by a tilt movement of the support arm 12 in such a manner that the holding mandrel 6 faces downward. In this way, a supply roll 8 can be received directly via the holding mandrel 6 of the transport apparatus 1. A handling device 80 as provided according to FIG. 9 for the delivery of a supply roll 8 to the holding mandrel 6 can be omitted in this embodiment.

Figure 19:
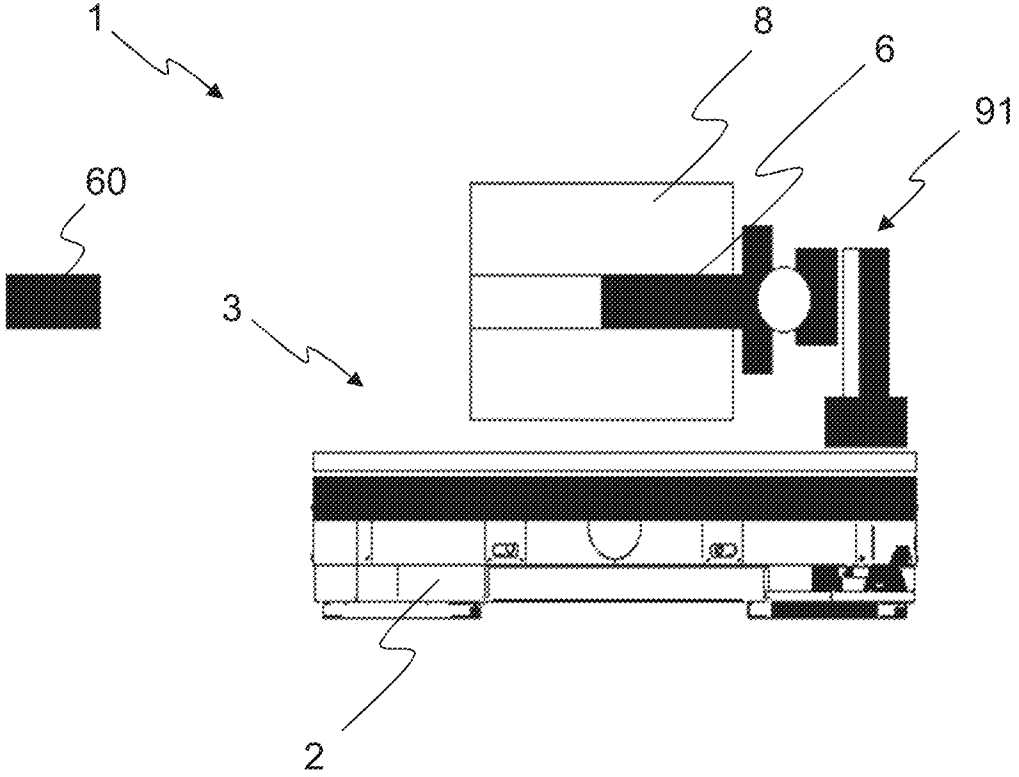

FIG. 19 shows a further embodiment of a transport apparatus 1 according to the invention in a schematic side view. The transport apparatus 1 of FIG. 19 differs from the previous embodiments by a smaller height or smaller dimensions of the driverless transport vehicle 2 forming part of the transport apparatus 1. In this context, the holding mandrel 6 and the packaging apparatus's 20 machine mandrel referred to with the reference number 60 are already aligned with each other prior to a slight height adjustment being carried out by the linear actuator 91, if required. The supply roll 8 can thus be directly delivered to the machine mandrel 60 of a packaging apparatus 20 without elaborate adjustment of the holding mandrel 6.

Figure 20:
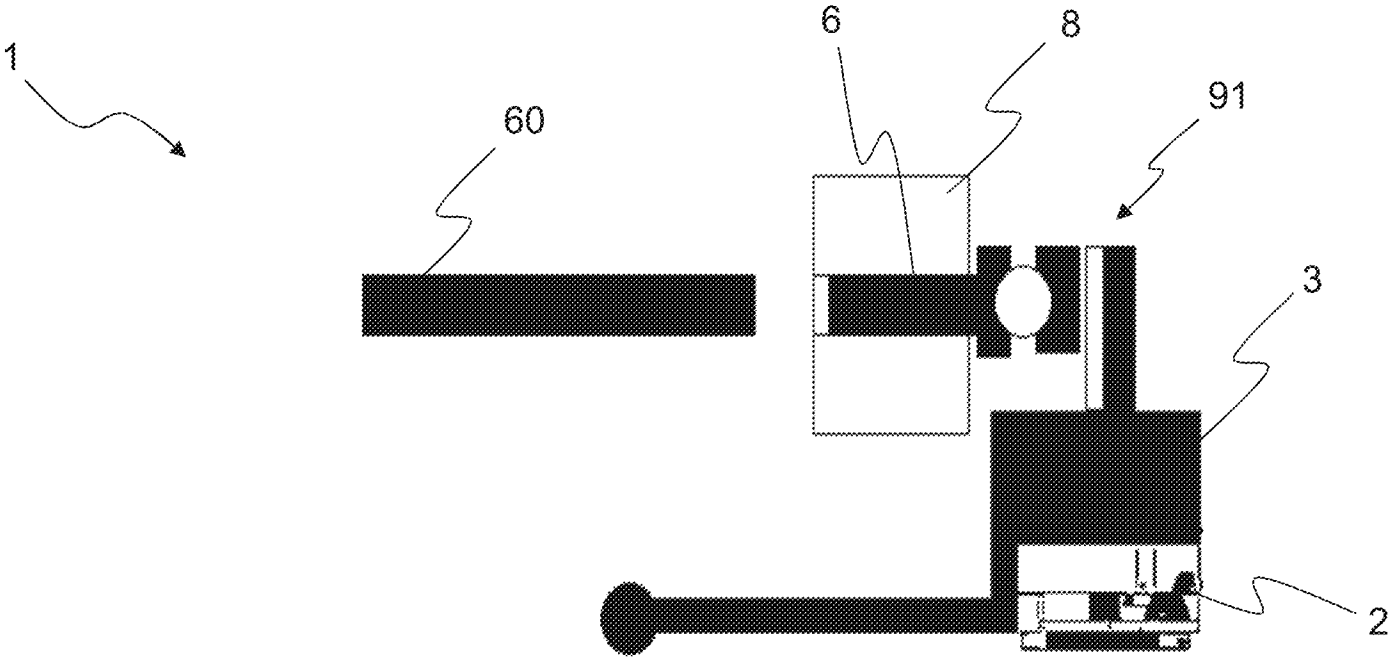

FIG. 20 shows a further embodiment of a transport apparatus 1 according to the invention. In order to deliver supply rolls 8 to the machine mandrel 60 of a packaging apparatus 20 in the above-described embodiments, the holding mandrel 6 with the supply roll 8 is brought into a working position AP (cf. FIG. 17C), in which working position AP the holding mandrel 6 and the supply roll 8 are situated outside a lateral circumference of the driverless transport vehicle 2.

The embodiment of the transport apparatus 1 of FIG. 20 is designed such that the transport apparatus 1 can partly drive under a packaging apparatus 20. In this way, the supply roll 8 can be delivered to the machine mandrel 60 without previously moving the supply roll 8 and the holding mandrel 6 beyond the lateral circumference of the transport vehicle 2.

Figure 21:
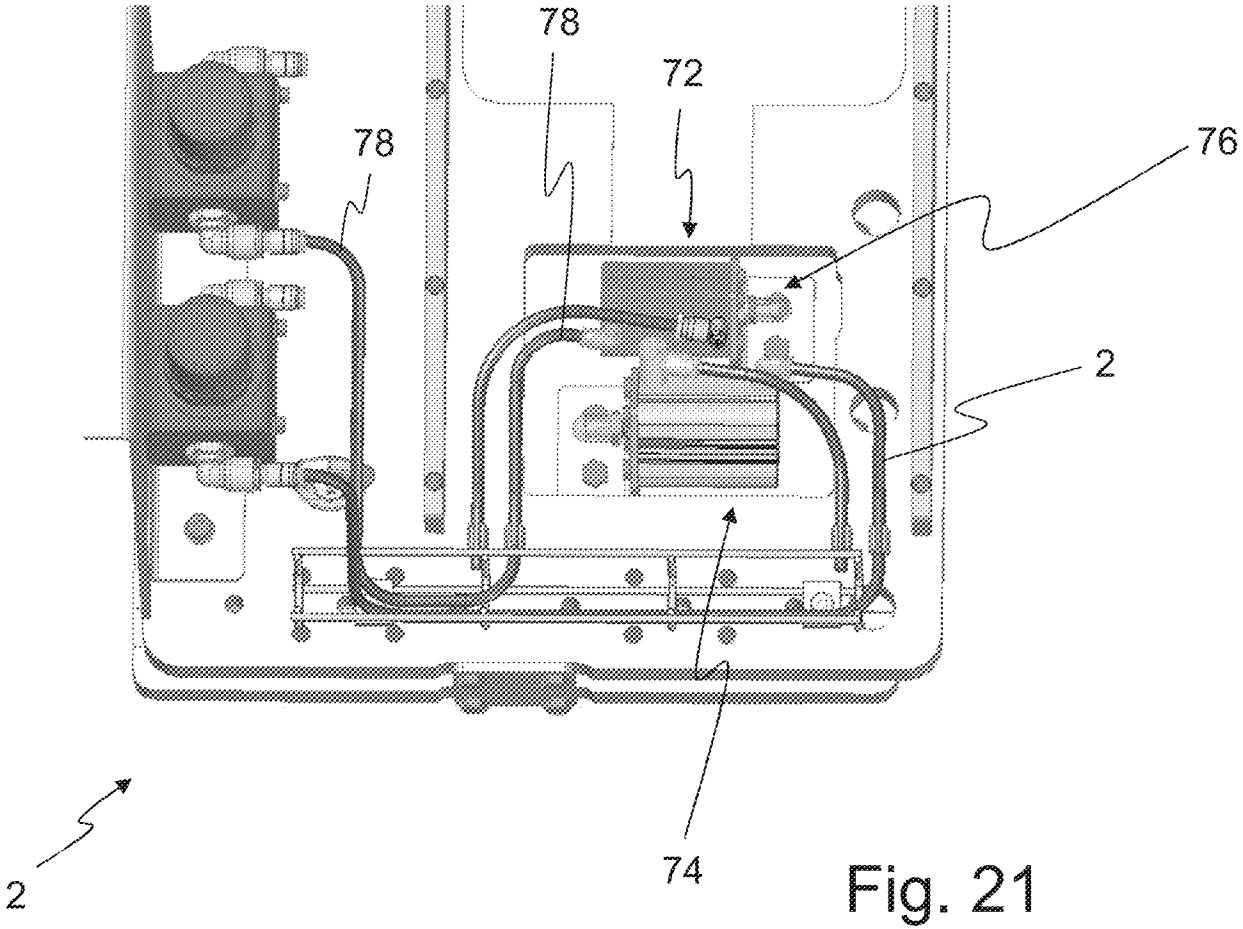
FIG. 21 shows further aspects such as can be provided in various embodiments of the transport apparatus according to the invention.

FIG. 21 shows further aspects such as can be provided in various embodiments of the transport apparatus 1 according to the invention. In particular, individual components of an embodiment of a driverless transport vehicle 2 are illustrated once more.

In other embodiments, the components illustrated in FIG. 21 can also be designed as part of an adapter 3 or they can be arranged on an adapter 3. It is conceivable, for example, that the components are arranged on or in the vicinity of a holding mandrel 6. The driverless transport vehicle 2 has an actuating mechanism 76 with two pneumatic cylinders 72 and 74. Via the pneumatic cylinders 72 and 74, it is possible to move a non-illustrated carriage of the adapter 3 back and forth when the adapter 3 is connected to the driverless transport vehicle 2. At least one holding mandrel 6 that can carry a supply roll 8 is attached to the carriage.

The movement in this context is carried out along a direction or an axis aligned parallel to a floor surface and perpendicular to a longitudinal axis of the supply roll 8. By such a movement, the supply roll 8 can be adjusted transverse to the packaging apparatus 20 if the supply roll 8 does not accurately meet with the machine mandrel 60 of a packaging apparatus 20. In the present context, the pressure required for the particular positioning movement is applied to the pneumatic cylinders 72 and 74 via the pneumatic lines 78.

It is also possible that a supply roll 8 meets with a machine mandrel 60 of a packaging machine and that the movement transverse to the packaging apparatus 20, if required, is only carried out subsequently or after a contact of the supply roll 8 with the machine mandrel 60. In this context, the pneumatic cylinders 72 and 74 can carry out a return stroke or remain in an extended position, as required.

As already mentioned above, the transport apparatus 1 can comprise a tilt sensor. The application of pressure can be carried out in consideration of values supplied by the tilt sensor. In this way, the particular supply roll 8 can be held precisely in the particular position even under conditions of a sloping floor, because the pressure application is adjustable in such embodiments to the floor conditions determined by the tilt sensor determined.

Other actuators that adjust the carriage along the direction described can be provided instead of the pneumatic cylinders 72 and 74. Electric cylinders, for example, are suited to bring about the described adjustment. It is also possible that a mechanical construction is provided instead of the pneumatic cylinders to adjust the carriage along the described direction.

The invention has been described with reference to a preferred embodiment. Those skilled in the art will appreciate that numerous changes and modifications can be made to the preferred embodiments of the invention and that such changes and modifications can be made without departing from the spirit of the invention. It is therefore intended that the appended claims cover all such equivalent variations as fall within the true spirit and scope of the invention.

It should be explicitly mentioned at this point that all aspects and embodiment variants explained in the context of the apparatus according to the invention can likewise pertain to or constitute partial aspects of the method or the system according to the invention. If specific aspects and/or interrelations and/or effects relating to the apparatus according to the invention are referred to at some point in the present description or in the claims definitions, this therefore likewise pertains to the method and to the system according to the invention. The same applies conversely, so that all aspects and embodiment variants explained in the context of the method according to the invention can likewise pertain to or constitute partial aspects of the apparatus according to the invention. If specific aspects and/or interrelations and/or effects relating to the method according to the invention are referred to at some point in the present description or in the claims definitions, this therefore likewise pertains to the apparatus according to the invention.

LIST OF REFERENCE NUMBERS

1 Transport apparatus
2 Driverless transport vehicle
3 Adapter
5 Frame structure
6 Holding mandrel
7 Top frame
8 Supply roll
9 Hollow cylindrical core (of the supply roll 8)
11 Support feet
12 Support arm
13 Cover
14 Actuator
15 Tunnel
16 Terminal box
17 Actuator cylinder
19 Reference bar
20 Packaging apparatus
22 Pressure cylinder
23 Pressure plate
32 Coupling medium
34 Clamp bolt
36 Centering bolt
38 Navigation aid
44 Plug
46 Mating plug
50 Lifting unit
51 Lifting mechanism
52 Receiving bar
55 Sensor system
56 Centering bushing
58 Clamping mechanism
60 Machine mandrel
61 Free end (machine mandrel 60)
62 Insertion plate
64 Sealing bar
67 Suction shaft
70 Pallet
72 Pneumatic cylinder
74 Pneumatic cylinder
76 Actuating mechanism
78 Pneumatic line
80 Handling device
82 Articulated robot
84 Clamping mandrel
86 Camera system
88 Turning station
90 Linear actuator
91 Further linear actuator
100 Packaging system
AP Working position
FP Driving position
H1 Horizontally oriented axis
H2 Further horizontally oriented axis
S Control device and/or regulating device

The invention claimed is:

1. A transport apparatus (1) for supply rolls (8) with packaging material wound thereon comprising:

at least one driverless transport vehicle (2);

at least one adapter (3), wherein the at least one adapter (3) is separably connectable to the at least one driverless transport vehicle (2) and capable of holding at least one supply roll (8), wherein the at least one driverless transport vehicle (2) has a plug (44), and wherein the at least one adapter (3) comprises a mating plug (46), which corresponds to the plug (44), wherein the plug (44) and the mating plug (46) are pluggable into each other via an actuator, wherein an electric or fluidic connection is producible between the at least one driverless transport vehicle (2) and the at least one adapter (3).

2. The transport apparatus of claim 1, wherein the at least one adapter (3) comprises at least one holding mandrel (6), on which at least one holding mandrel (6) a supply roll (8) can be positioned.

3. The transport apparatus of claim 2, wherein the at least one holding mandrel (6) is capable of being adjustable between at least one working position (AP) and at least one driving position (FP), and wherein, in the at least one working position (AP), the at least one holding mandrel (6) extends beyond a lateral circumference of the at least one driverless transport vehicle (2) or is situated outside the lateral circumference of the at least one driverless transport vehicle (2), and wherein, in the at least one driving position (FP), the at least one holding mandrel (6) is situated at least in sections or completely behind the lateral circumference of the at least one driverless transport vehicle (2).

4. The transport apparatus of claim 3, wherein:

the at least one adapter (3) has at least one support arm (12), on which at least one support arm (12) the at least one holding mandrel (6) is arranged, and wherein, in order to transfer the at least one holding mandrel (6) from the at least one working position (AP) into the at least one driving position (FP) and from the at least one driving position (FP) into the at least one working position (AP), the at least one support arm (12) is swivelable about a horizontally oriented axis, or the at least one adapter (3) has at least one support arm (12), on which at least one support arm (12) the at least one holding mandrel (6) is arranged, and wherein the transport apparatus (1) has at least one linear actuator (90), to which the at least one support arm (12) is connected, wherein, in order to transfer the at least one holding mandrel (6) from the at least one working position (AP) into the at least one driving position (FP) and from the at least one driving position (FP) into the at least one working position (AP), the at least one support arm (12) is adjustable in a linear direction via the at least one linear actuator (90).

5. The transport apparatus of claim 4, in which the at least one adapter (3) has at least one tilt mechanism that is capable of performing a tilt adjustment about a horizontally oriented axis (H2) of the at least one holding mandrel (6) relative to the at least one support arm (12).

6. The transport apparatus of claim 5, further comprising: at least one tilt sensor, an actuator, and a control device or regulating device(S) connected to the at least one tilt sensor and the actuator, wherein the control device or regulating device(S) is capable of detecting an actual tilt of the at least one holding mandrel (6) relative to the support arm (12) with the help of the at least one tilt sensor, and wherein the control device or regulating device(S) can automatically control the actuator to adjust the tilt position of the at least one holding mandrel (6) if the actual tilt of the at least one holding mandrel (6) relative to the support arm (12) deviates from a specified target tilt.

7. The transport apparatus of claim 1, wherein:

the at least one driverless transport vehicle (2) or the at least one adapter (3) has a lifting mechanism (51), via which lifting mechanism (51) the at least one adapter (3) is liftable relative to the at least one transport vehicle (2) for the purpose of the independent receiving, such that the at least one adapter (3) loses an up to then existing surface contact with a floor surface, or wherein:

the at least one driverless transport vehicle (2) and the at least one adapter (3) interact via a centering mechanism, which centering mechanism can align the at least one adapter (3) relative to the at least one transport vehicle (2) when the adapter (3) is independently received via the at least one transport vehicle (2), or wherein: —the at least one driverless transport vehicle (2) and the at least one adapter (3) interact via a clamp bolt (34) and a clamping mechanism (58), via which clamp bolt (34) and clamping mechanism (58) the at least one adapter (3) can be at least largely immovably fixed to the driverless transport vehicle (2).

8. The transport apparatus of claim 1, wherein the at least one driverless transport vehicle (2) is in contact with at least one sensor system (55), via which at least one sensor system (55) the at least one driverless transport vehicle (2) can detect an actual position of the at least one adapter and move in consideration of the detected actual position into a receiving position that is suitable to independently receive the at least one adapter (3).

9. The transport apparatus of claim 1, further comprising an actuating mechanism (76), via which the supply roll (8) being held via the at least one adapter (3) can be moved relative to the driverless transport vehicle along an axis that is oriented parallel or substantially parallel to a floor surface and perpendicular to a longitudinal axis of the supply roll (8).

10. The transport apparatus (1) of claim 1, wherein the at least one driverless transport vehicle (2) can independently receive the at least one adapter (3) and independently connect to the at least one received adapter (3) in a separable manner, or wherein:

the at least one driverless transport vehicle (2) can independently separate an existing connection to the at least one already received adapter (3) and independently deposit the at least one already received adapter (3).

11. A packaging system (100) used to package articles comprising:

at least one packaging apparatus (20), which can unwind packaging material from a supply roll (8), and which is capable of applying the packaging material unwound from the supply roll (8) onto articles, at least one driverless transport vehicle (2), which interacts with the at least one packaging apparatus (20) in feeding supply rolls (8) to the packaging apparatus (20), and at least one adapter (3), wherein the at least one adapter (3) can be separably connected to the at least one driverless transport vehicle (2) and is capable of holding at least one supply roll (8), wherein;

the at least one driverless transport vehicle (2) has a plug (44), and wherein the at least one adapter (3) comprises a mating plug (46), which corresponds to the plug (44), wherein the plug (44) and the mating plug (46) are pluggable into each other via an actuator, wherein an electric or fluidic connection is producible between the at least one driverless transport vehicle (2) and the at least one adapter (3).

12. The packaging system of claim 11, comprising a handling device (80) including an articulated robot (82), that delivers supply rolls (8) to the at least one adapter (3).

13. The packaging system of claim 12, further comprising at least one navigation aid (38) having a triangular geometry, wherein the at least one driverless transport vehicle (2) has a sensor system (55), wherein the sensor system (55) of the at least one driverless transport vehicle (2) can detect a position of the at least one navigation aid (38), and wherein the driverless transport vehicle (2) is capable of independently, and in consideration of the position of the at least one navigation aid (38) detected by the sensor system (55), moving toward a delivery position provided for a supply roll (8) to be passed on to the at least one packaging apparatus (20).

14. A method used to operate a packaging apparatus, comprising:

feeding at least one supply roll (8) to at least one packaging apparatus (20) with at least one driverless transport vehicle (2) comprising at least one adapter (3) that is separably connected to the driverless transport vehicle (20), wherein the at least one driverless transport vehicle (2) has a plug (44), and wherein the at least one adapter (3) comprises a mating plug (46), which corresponds to the plug (44), wherein the plug (44) and the mating plug (46) are pluggable into each other via an actuator, wherein an electric or fluidic connection is producible between the at least one driverless transport vehicle (2) and the at least one adapter (3), and wherein the at least one driverless transport vehicle (2) transports the at least one supply roll (8), being held via the at least one adapter (3), along a defined transfer path to the at least one packaging apparatus (20), and introducing the at least one supply roll (8) into the at least one packaging apparatus (2);

unwinding packaging material from the at least one supply roll (8), and applying the packaging material unwound from the at least one supply roll (8) onto articles.

15. The method of claim 14, wherein the at least one driverless transport vehicle (2) independently moves toward the at least one adapter (3), and independently connects to the at least one adapter (3).

16. The method of claim 14, wherein:

the at least one driverless transport vehicle or the at least one adapter (3) has a lifting mechanism (51), via which lifting mechanism (51) the at least one adapter (3) is lifted relative to the at least one driverless transport vehicle (2), with the at least one adapter (3) losing its surface contact with a floor surface after the at least one driverless transport vehicle (2) has moved toward the at least one adapter (3), or wherein the at least one driverless transport vehicle (2) and the at least one adapter (3) together form a centering mechanism, via which centering mechanism the at least one adapter is aligned relative to the at least one driverless transport vehicle (2) when the adapter is independently received via the at least one driverless transport vehicle (2), or wherein the at least one driverless transport vehicle (2) and the at least one adapter (3) interact via a clamp bolt (34) and a clamping mechanism (58), via which clamp bolt (34) and clamping mechanism (58) the at least one adapter (3) and the at least one transport vehicle (2) are connected.

17. The method of claim 14, wherein the at least one driverless transport vehicle (2) has at least one sensor system (55) that detects an actual position of the at least one adapter and moves in consideration of the detected actual position into a receiving position that is suitable to independently receive the at least one adapter (3).

18. The method of claim 14, wherein, after having transported the at least one supply roll (8), the at least one adapter (3) independently introduces the at least one supply roll (8) into the at least one packaging apparatus (20).

19. The method of claim 18, wherein the at least one adapter (3) comprises at least one holding mandrel (6), wherein the at least one holding mandrel (6):

in at least one working position (AP), receives at least one supply roll (8) and is then transferred together with the at least one supply roll (8) into at least one driving position (FP), such that, by the transfer of the at least one holding mandrel (6) from the at least one working position (AP) into the at least one driving position (FP), a center of gravity of the at least one driverless transport vehicle (2) and the at least one supply roll (8) is shifted toward a middle of the at least one driverless transport vehicle (2), and wherein the at least one holding mandrel (6) is situated in the at least one driving position (FP) during the transport of the at least one supply roll (8) along the defined transfer path, and wherein:

the transfer of the at least one holding mandrel (6) from the at least one working position (AP) into the at least one driving position (FP) is achieved by a swivel movement of at least one support arm (12) of the at least one adapter (3), on which at least one support arm (12) the at least one holding mandrel (6) is arranged, or wherein the transfer of the at least one holding mandrel (6) from the at least one working position (AP) into the at least one driving position (FP) is achieved by a movement of the at least one holding mandrel (6) via at least one linear actuator (90).

20. The method of claim 14, wherein at least one navigation aid (38) having a triangular geometry, is arranged at a defined position in the range of the at least one packaging apparatus (20), wherein the at least one driverless transport vehicle (2) has a sensor system (55) that detects a position of the at least one navigation aid (38), and wherein the driverless transport vehicle (2) moves toward a specific delivery position in consideration of the detected position of the at least one navigation aid (38), and in the delivery position then passes on at least one supply roll (8) to the at least one packaging apparatus (20).

21. The method of claim 14 wherein the unwinding step comprises unwinding packaging material from the at least one supply roll (8) that was fed to the at least one packaging apparatus (20) with the help of the at least one driverless transport vehicle (2).

* * * * *